US010487602B2

(12) United States Patent
Evans et al.

(10) Patent No.: US 10,487,602 B2
(45) **Date of Patent: *Nov. 26, 2019**

(54) HYDRAULIC CONTROL OF DOWNHOLE TOOLS

(71) Applicant: Halliburton Energy Services, Inc., Houston, TX (US)

(72) Inventors: John Gerard Evans, The Woodlands, TX (US); Bradley David Dunbar, The Woodlands, TX (US); William Browning Bradford, Willis, TX (US); David Wayne Cawthon, Tomball, TX (US); Jean-Pierre Lassoie, Anderlecht (BE)

(73) Assignee: Halliburton Energy Services, Inc., Houston, TX (US)

( * ) Notice: Subject to any disclaimer, the term of this patent is extended or adjusted under 35 U.S.C. 154(b) by 148 days.

This patent is subject to a terminal disclaimer.

(21) Appl. No.: 15/553,424

(22) PCT Filed: Mar. 24, 2015

(86) PCT No.: PCT/US2015/022311

§ 371 (c)(1),
(2) Date: Aug. 24, 2017

(87) PCT Pub. No.: WO2016/153492

PCT Pub. Date: Sep. 29, 2016

(65) Prior Publication Data

US 2018/0045003 A1 Feb. 15, 2018

(51) Int. Cl.
*E21B 21/10* (2006.01)
*E21B 4/02* (2006.01)
(Continued)

(52) U.S. Cl.
CPC ..... *E21B 21/10* (2013.01); *E21B 4/02* (2013.01); *E21B 21/103* (2013.01); *E21B 21/12* (2013.01); *E21B 34/106* (2013.01)

(58) Field of Classification Search
CPC ..... E21B 21/08; E21B 21/10; E21B 21/12; E21B 21/103; E21B 34/06; E21B 34/08;
(Continued)

(56) References Cited

U.S. PATENT DOCUMENTS 6,279,670 B1 * 8/2001 Eddison ..... E21B 4/02 175/107
6,708,785 B1 * 3/2004 Russell ..... E21B 17/1014 166/240
(Continued)

FOREIGN PATENT DOCUMENTS

WO 2014133487 A2 9/2014

OTHER PUBLICATIONS

International Search Report and Written Opinion issued in corresponding application No. PCT/US2015/022311 dated Dec. 2, 2015, 10 pgs.

*Primary Examiner* — David Carroll
(74) *Attorney, Agent, or Firm* — Chamberlain Hrdlicka

(57) ABSTRACT

A well tool apparatus comprises a control arrangement configured to control response of the downhole tool by varying a bore-annulus pressure difference. The control arrangement includes a valve piston longitudinally slidable in a generally tubular controller housing that is in operation substantially co-axial with the wellbore, to open or close a valve port to a fluid flow connection between the drill strings interior and the tool. A latch mechanism is configured to latch the valve piston against movement in one axial direction, keeping the valve piston in an open or a closed condition. Unlatching of the valve piston requires displacement thereof in the other axial direction to a mode change
(Continued)

position. A stay member is automatically displaceable under hydraulic actuation responsive to bore-annulus pressure differences above a trigger threshold value, to obstruct movement of the latched valve piston under hydraulic actuation to the mode change position.

19 Claims, 21 Drawing Sheets

(51) Int. Cl.
*E21B 21/12* (2006.01)
*E21B 34/10* (2006.01)

(58) Field of Classification Search
CPC ..... E21B 4/02; E21B 23/004; E21B 23/006; E21B 23/04
See application file for complete search history.

(56) References Cited

U.S. PATENT DOCUMENTS

| | | | | |
|---|---|---|---|---|
| 9,453,380 | B2 * | 9/2016 | Hardin, Jr. | E21B 21/08 |
| 2005/0241858 | A1 * | 11/2005 | Eppink | E21B 10/322 175/325.1 |
| 2009/0032308 | A1 * | 2/2009 | Eddison | E21B 10/322 175/267 |
| 2011/0127044 | A1 * | 6/2011 | Radford | E21B 10/322 166/373 |
| 2011/0284233 | A1 * | 11/2011 | Wu | E21B 10/32 166/321 |
| 2012/0199363 | A1 * | 8/2012 | Hu | E21B 10/322 166/373 |
| 2018/0038201 | A1 * | 2/2018 | Evans | E21B 23/006 |

* cited by examiner

HYDRAULIC CONTROL OF DOWNHOLE TOOLS

TECHNICAL FIELD

The present application relates generally to downhole tools in drilling operations, and to methods of operating downhole tools. Some embodiments relate more particularly to fluid-activated control systems, mechanisms and methods for downhole tools. The disclosure also relates to downhole reamer deployment control by fluid-pressure sequencing.

BACKGROUND

Boreholes for hydrocarbon (oil and gas) production, as well as for other purposes, are usually drilled with a drill string that includes a tubular member (also referred to as a drilling tubular) having a drilling assembly which includes a drill bit attached to the bottom end thereof. The drill bit is rotated to shear or disintegrate material of the rock formation to drill the wellbore. The drill string often includes tools or other devices that require remote activation and deactivation during drilling operations. Such tools and devices include, among other things, reamers, stabilizers or force application members used for steering the drill bit.

Electro-mechanical control systems are often unreliable in such drilling environments. Remote control of downhole tool activation by controlling fluid pressure in the drill string often allow only a single activation/deactivation cycle, after which the control system is to be reset, while reduction in effective drill string diameter result in some systems. Utilization of the drilling fluid (e.g., mud cycled down the drill string and back up a borehole annulus) introduce the risk of inadvertent tool activation during normal drilling operations.

BRIEF DESCRIPTION OF THE DRAWINGS

Some embodiments are illustrated by way of example and not limitation in the figures of the accompanying drawings in which.

DETAILED DESCRIPTION

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

Figure 1:
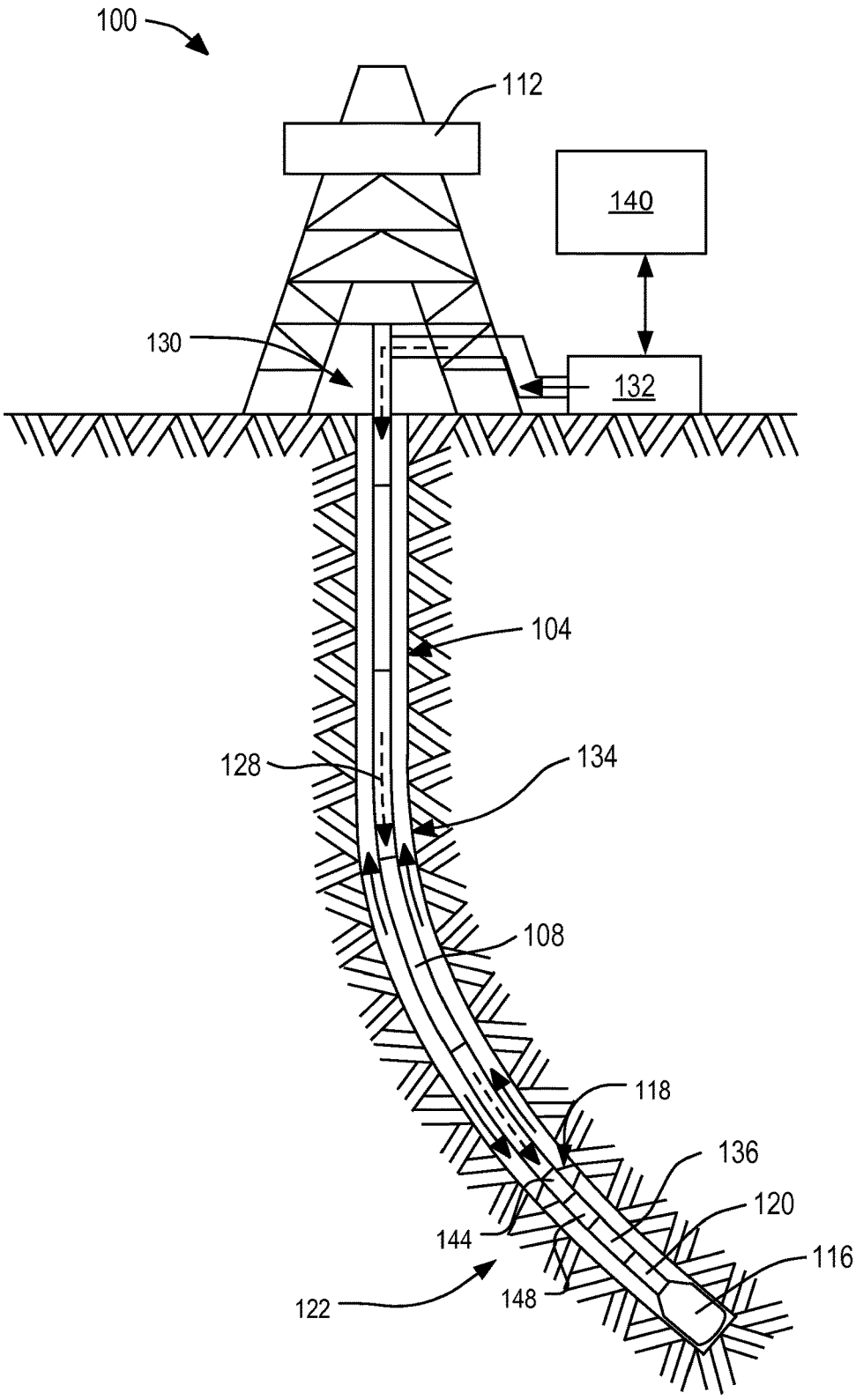
FIG. 1 depicts a schematic diagram of a drilling installation that includes a drilling apparatus that provides a control arrangement for remote fluid-activated control of tool activation, in accordance with an example embodiment.

FIG. 1 is a schematic view of an example embodiment of a system to control downhole tool operation with fluid-pressure. A drilling installation 100 includes a subterranean borehole 104 in which a drill string 108 is located. The drill string 108 may comprise jointed sections of drill pipe suspended from a drilling platform 112 secured at a wellhead. A downhole assembly or bottom hole assembly (BHA) 122 at a bottom end of the drill string 108 may include a drill bit 116 to disintegrate earth formations at a leading end of the drill string 108, to pilot the borehole 104, and one or more reamer assemblies 118, uphole of the drill bit 116 to widen the borehole 104 by operation of selectively expandable cutting elements.

The borehole 104 is thus an elongated cavity that is substantially cylindrical, having a substantially circular cross-sectional outline that remains more or less constant along the length of the borehole 104. The borehole 104 may in some cases be rectilinear, but may often include one or more curves, bends, doglegs, or angles along its length. As used with reference to the borehole 104 and components therein, the "axis" of the borehole 104 (and therefore of the drill string 108 or part thereof) means the centerline of the cylindrical borehole 104. "Axial" thus means a direction along a line substantially parallel with the lengthwise direction of the borehole 104 at the relevant point or portion of the borehole 104 under discussion; "radial" means a direction substantially along a line that intersects the borehole axis and lies in a plane perpendicular to the borehole axis; "tangential" means a direction substantially along a line that does not intersect the borehole axis and that lies in a plane perpendicular to the borehole axis; and "circumferential" means a substantially arcuate or circular path described by rotation of a tangential vector about the borehole axis.

As used herein, movement or location "forwards" or "downhole" (and related terms) means axial movement or relative axial location towards the drill bit 116, away from the surface. Conversely, "backwards," "rearwards," or "uphole" means movement or relative location axially along the borehole 104, away from the drill bit 116 and to towards the earth's surface.

A measurement and control assembly 120 may be included in the BHA 122, which also includes measurement instruments to measure borehole parameters, drilling performance, and the like.

Drilling fluid (e.g. drilling "mud," or other fluids that may be in the well), is circulated from a drilling fluid reservoir 132, for example a storage pit, at the earth's surface, and coupled to the wellhead, indicated generally at 130, by means of a pump (not shown) that forces the drilling fluid down a drilling bore 128 provided by a hollow interior of the drill string 108, so that the drilling fluid exits under high pressure through the drill bit 116. After exiting from the drill string 108, the drilling fluid occupies a borehole annulus 134 defined between the drill string 108 and a wall of the borehole 104. Although many other annular spaces may be associated with the system 102, references to annular pressure, annular clearance, and the like, refer to features of the borehole annulus 134, unless otherwise specified.

Note that the drilling fluid is pumped along the inner diameter (i.e., the bore 128) of the drill string 108, with fluid flow out of the bore 128 being restricted at the drill bit 116.

The drilling fluid then flows upwards along the annulus 134, carrying cuttings from the bottom of the borehole 104 to the wellhead 130, where the cuttings are removed and the drilling fluid may be returned to the drilling fluid reservoir 132. Fluid pressure in the bore 128 is therefore greater than fluid pressure in the annulus 134. Unless the context indicates otherwise, the term "pressure differential" means the difference between general fluid pressure in the bore 128 and pressure in the annulus 134.

In some instances, the drill bit 116 is rotated by rotation of the drill string 108 from the platform 112. In this example embodiment, a downhole motor 136 (such as, for example, a so-called mud motor or turbine motor) disposed in the drill string 108 and, this instance, forming part of the BHA 122, may rotate the drill bit 116. In some embodiments, the rotation of the drill string 108 may be selectively powered by one or both of surface equipment and the downhole motor.

The system 102 may include a surface control system 140 to receive signals from sensors and devices incorporated in the drill string 108 (typically forming part of the BHA 122). The surface control system 140 may display drilling parameters and other information on a display or monitor that is used by an operator to control the drilling operations. Some drilling installations may be partly or fully automated, so that drilling control operations (e.g., control of operating parameters of the motor 136 and control of downhole tool deployment through pressure sequencing of the drilling fluid, as described herein) may be either manual, semi-automatic, or fully automated. The surface control system 140 may comprise a computer system having one or more data processors and data memories. The surface control system 140 may process data relating to the drilling operations, data from sensors and devices at the surface, data received from downhole, and may control one or more operations of downhole tools and devices that are downhole and/or surface devices.

The drill string 108 may include one or more downhole tools instead of or in addition to the reamer assemblies 118 mentioned previously. The downhole tools of the drill string 108, in this example, thus includes at least one reamer assembly 118 located in the BHA 122 to enlarge the diameter of the borehole 104 as the BHA 122 penetrates the formation. In other embodiments, a reamer assembly 118 may be positioned uphole of and coupled to the BHA 122. Each reamer assembly 118 may comprise one or more circumferentially spaced blades or other cutting elements that carry cutting structures. The reamer assembly 118 houses a reamer 144 that is selectively extended and retracted radially from a housing of the reamer assembly 118, to selectively increase and decrease in diameter.

In this embodiment, the reamer 144 is hydraulically actuated by use of the pressurized drilling fluid. The pressurized drilling fluid is also used to select a deployment mode of the reamer 144. In this example, deployment control mechanisms to achieve such fluid-pressure control of the reamer 144 are provided by a controller 148 that comprises an assembly having a drill-pipe body or housing 215 (see FIG. 2) connected in-line in the drill string 108. In this embodiment, the controller 148 is mounted downhole of the associated reamer assembly 118.

Fluid Pressure Considerations

Note that, despite the benefits fluid-pressure control of tool deployment (which will be discussed presently), such fluid-pressure control may introduce difficulties in performing drilling operations. There is seldom, for example, a simple direct correspondence between fluid pressure values and desired reamer deployment. Although reaming operations in this example coincide with high fluid pressure in the bore 128 (also referred to as bore pressure or internal pressure), the reamer 144 is not to be deployed with every occurrence of high bore pressure.

The bore pressure may, for example be ramped up to drive the drill bit 116 via the motor 136 when the borehole 104 is being drilled. Reamer deployment during such a drilling phase is often to be avoided.

A function of the controller 148, in this embodiment, is to selectively adjust the way in which the reamer 144 responds to certain fluid pressure conditions. The reamer assembly 118 may be bi-modal, selectively being disposed in either a dormant mode or an active mode. In the dormant mode, the reamer 144 is retracted and remains retracted regardless of high bore pressures (e.g., pressures at operating levels for downhole machine such as the motor 136). In the active mode, the reamer 144 is dynamically responsive to bore pressure, so that high bore pressures automatically and invariably result in deployment of the reamer 144 by radial extension of the reamer 144's cutting elements. Control of the reamer assembly 118 to selectively disclose it to one of the modes or the other may be by producing a predefined sequence of bore pressure values. In an example, mode switching comprises application of a low pressure (relative to tool operating pressures) for longer than a predefined trigger time. Much of the description that follows discusses mechanisms to implement such pressure-sequence mode control of the reamer assembly 118.

Overview of Controller Operation

Figure 2A:
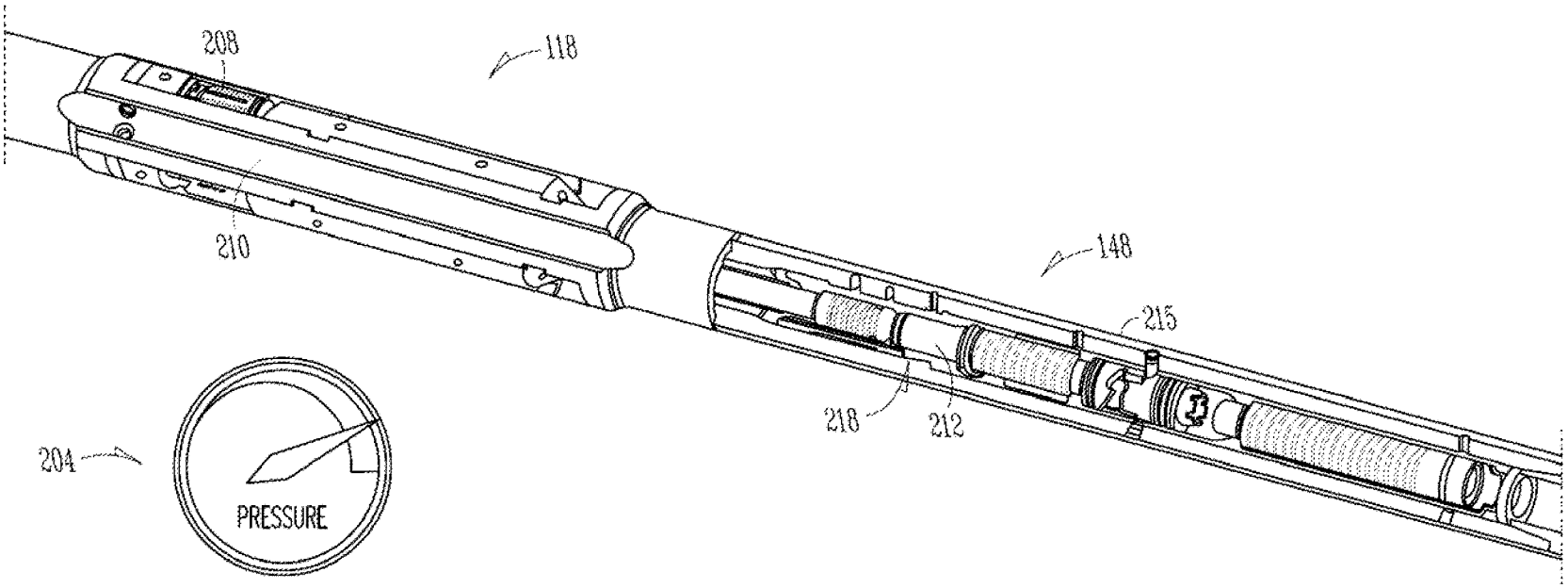
FIGS. 2A-2B depict partially sectioned three-dimensional views of a drilling apparatus for remote fluid-activated control of tool activation, in accordance with an example embodiment, an example tool in the form of a reamer being deployed in FIG. 2A and being retracted in FIG. 2B.

FIG. 2A shows the reamer assembly 118 in the dormant mode. As indicated by schematic pressure gauge 204, the drill string 108 has a high bore pressure, in this example corresponding to an operational pressure of the reamer assembly 118. "Operational pressure" here means pressure at or greater than bore pressures at which the relevant tool is to perform its primary function, in the case of the reamer assembly 118 being bore pressures during reaming.

Despite such operational pressure levels, the reamer 144 in FIG. 2A is in a retracted condition, in which reamer cutting elements in the example form of reamer arms 208 are retracted into a tubular reamer body 210. The reamer arms 208 do not project beyond a radially outer surface of the reamer body 210, and therefore do not engage the wall of the borehole 104.

Figure 2B:
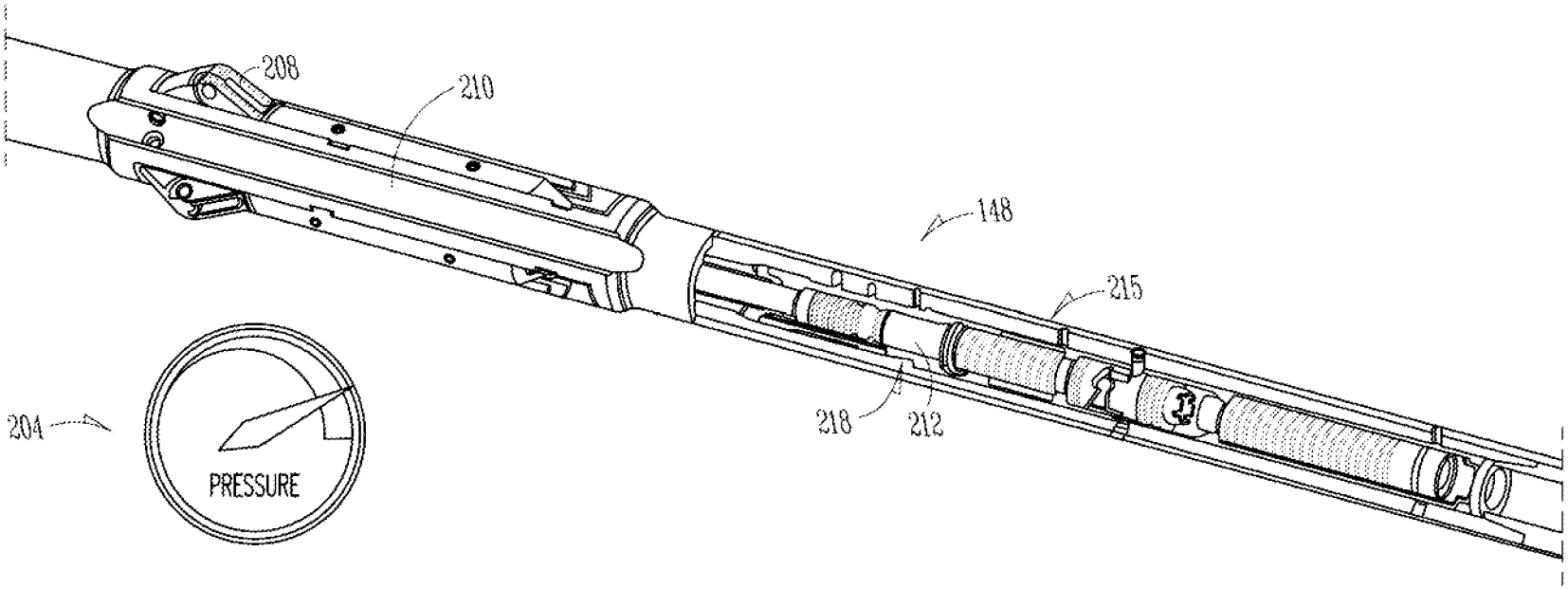

In FIG. 2B, however, the bore pressure is again at operational levels, but now the reamer 144 is in a deployed condition in which the reamer arms 208 are radially extended, standing proud of the reamer body 210 and projecting radially outwards from the reamer body 210 to make contact with the borehole wall for reaming of the borehole 104 when the reamer body 210 rotates with the drill string 108. In this example, the reamer arms 208 are mounted on the reamer body 210 in axially aligned, hingedly connected pairs that jackknife into deployment, when actuated.

The difference in functionality of the reamer assembly 118 and controller 148 between the dormant mode of FIG. 2A and the active mode of FIG. 2B is due to the respective axial positions of a valve closure member in the example form of a valve piston 212 within a controller housing 215 having a generally tubular wall 423 (FIG. 4). The controller 148 provides a valve port 218 to place the bore 128 in fluid flow communication with the reamer assembly 118. Exposure of the reamer assembly 118 to operational bore pressures, via the valve port 218, allows hydraulic actuation of the reamer arms 208 towards their deployed position. In the dormant mode (FIG. 2A) the valve piston 212 is axially positioned such that it closes the valve port 218, thus isolating the reamer assembly 118 from bore pressure and rendering it unresponsive to high bore pressure values. In the active mode, the valve piston 212 is positioned axially further downhole in the controller housing 215 relative to its position in the dormant mode, so that the valve piston 212 is clear of the valve port 218, exposing the reamer assembly 118 to bore pressure fluctuations and allowing automatic reamer deployment responsive to operational fluid pressure in the bore 128.

Axial displacement of the valve piston 212 from its dormant mode position to its active mode position, and vice versa, is by application of a trigger pressure condition that includes application of a pressure differential lower than a pre-defined trigger threshold value (in this example being about 20 bar) for at least a trigger threshold interval (in this example being about 15 minutes). Higher threshold intervals may reduce inadvertent activation risks, but some operators may prefer shorter threshold intervals, and these intervals may thus be varied depending on drilling conditions and/or user preference. In some embodiments, the trigger threshold interval may be about one minute.

Various hydro-mechanical aspects and features of the controller 148 will now be described, but note that the axial position of the valve piston 212, in this example embodiment, determines the operational mode of the reamer system provided by the reamer assembly 118 and controller 148. The mechanisms and components described hereafter cooperate to facilitate axial positioning of the valve piston 212 as desired by remote pressure-sequence control from the surface control system 140.

Some components and mechanisms of the controller 148 that contribute to such pressure-controlled reamer deployment will now briefly be mentioned in a high-level overview, after which these features are described at greater length in the context of this example embodiment. Thereafter, functional interaction of the example controller components is discussed.

High-Level Functional Overview

Figure 3A:
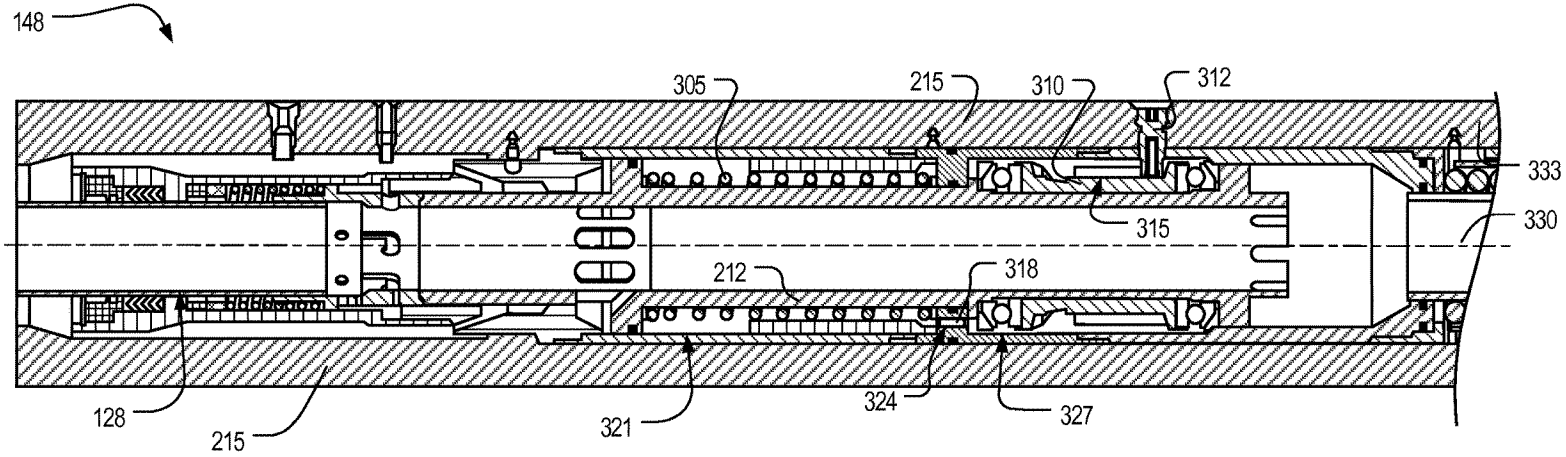
FIGS. 3A-3B depicts a longitudinal section of the drilling apparatus of FIG. 2, according to an example embodiment.
Figure 3B:
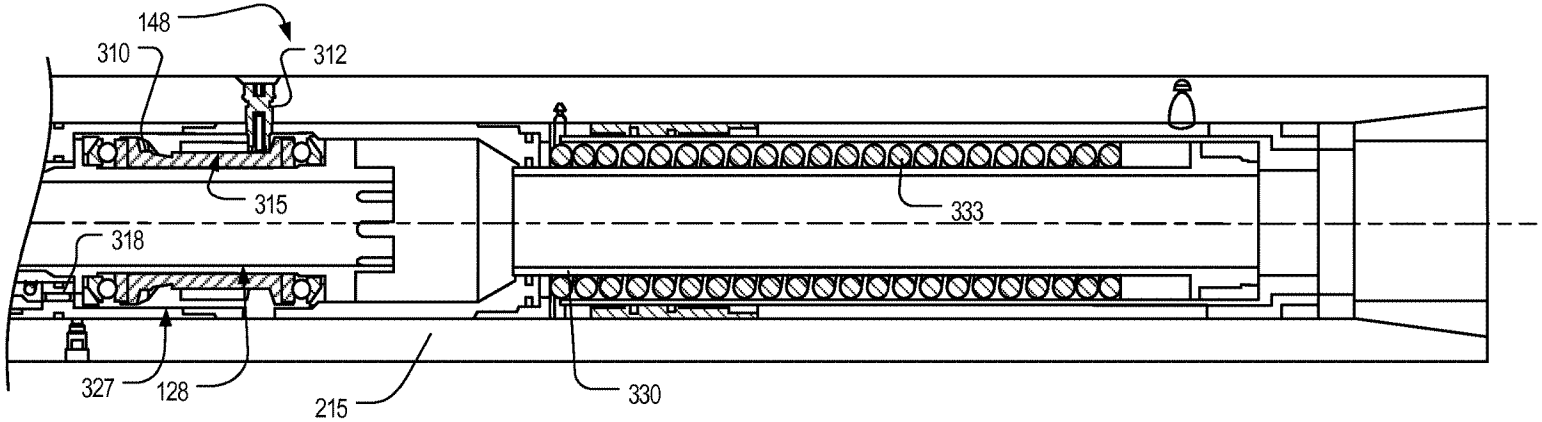

Numerous components acting directly and/or indirectly on the valve piston 212 to dispose it in either its dormant-mode position or its active-mode position can be seen in FIG. 3. The valve piston 212 is urged towards its dormant-mode position by a valve-closing bias arrangement in the example form of a closing spring 305 that acts between the controller housing 215 and the valve piston 212 to urge the valve piston 212 axially uphole, i.e. towards the left-hand side in FIG. 3. In the absence of hydraulic forces acting on the valve piston 212, the closing spring 305 would thus move the valve piston 212 uphole into a position where the valve port 218 is closed by a part of the valve piston 212 that acts as a valve closure member (see, e.g., valve closure sleeve 409 in FIG. 4). For clarity of illustration, the valve piston 212 is shown in the drawings to be of one-piece construction, but it may be comprised of two or more generally tubular members that are screwed together end-to-end, to facilitate assembly.

In the dormant mode, there is no obstruction to movement of the valve piston 212 into its closed position under the urging of the closing spring 305, absent fluid pressure. In the active mode, however, axial movement of the valve piston 212 towards the uphole end of the controller housing 215 (to close the valve port 218) is limited by a latch arrangement comprising a barrel cam 310 (which axially anchored to the valve piston 212 but is free to rotate about it) and a cooperating cam follower in the form of a latch pin 312 mounted on the controller housing 215. As will be described at greater length, the barrel cam 310 has a continuous recessed track 315 that is followed by the latch pin 312. The track 315 includes a latch slot 512 (FIG. 5) in which axial uphole movement of the valve piston 212 (to close the valve port 218) is stopped short of its valve-closing position by abutment of the latch pin 312 against a stopping end of the track 315's latch slot 512.

Switching to the active mode in this example thus comprises entry of the latch pin 312 into the latch slot 512 of the track 315 of the barrel cam 310, while switching to the dormant mode comprises escape of the latch pin 312 from the latch slot 512.

The valve piston 212 can move axially downhole within the controller housing 215, against the bias of the closing spring 305, when fluid pressure in the bore 128 is at operational levels ("high pressure/flow") or at a sub-operational levels ("low pressure/flow"). The speed of axial downhole movement of the valve piston 212 is limited by an opening speed control mechanism or retarding arrangement comprising a flow restrictor 318 that limits a rate of hydraulic flow through a flow control channel 324 from a control fluid reservoir 321 to a draw chamber 327. In this example, the flow restrictor 318 is a Lee Flosert that controls the rate at which oil can move through the flow control channel 324 from the control fluid reservoir 321 to the draw chamber 327 when there is a differential pressure across it. The effective flow rate through the flow restrictor 318 may thus be substantially constant for a range of pressure differences. Hence, the flow restrictor 318 controls the speed of movement of the valve piston 212, allowing accurate calculation of a trigger threshold interval for which the valve piston 212 is to move under hydraulic actuation in order to switch operational modes of the controller 148. The flow restrictor 318 may allow substantially unrestricted fluid movement in the opposite direction. Axial movement of the valve piston 212 downhole can also be blocked by a stay piston 330 mounted downhole of the valve piston 212 and urged axially downhole by a stay spring 333 to a rest position in which it is clear of interference with the valve piston 212. The stay piston 330 and its stay spring 333 are selected and arranged such that at high, operational mud pressure and/or flow, the stay piston 330 moves axially uphole, against the bias of the stay spring 333 (in an axial direction opposite to movement of the valve piston 212 under hydraulic drilling fluid actuation), to abut end-to-end against the valve piston 212, stopping further movement of the valve piston 212 axially downhole.

Due in part to operation of the flow restrictor 318, the stay piston 330 moves uphole faster than the valve piston 212 moves downhole, meeting and stopping the valve piston 212 before the latch pin 312 can escape or enter the latch slot 512 of the barrel cam 310, as the case may be. Thus, in the dormant mode, movement under operational pressure of the stay piston 330 blocks the valve piston 212 from advancing far enough downhole to clear the valve port 218 or allow the latch pin 312 to enter the latch slot 512 in the barrel cam 310. In the active mode fluid-pressure actuated uphole movement of the stay piston 330 blocks the valve piston 212 from advancing far enough downhole to exit the latch slot in the barrel cam 310, thus keeping the valve piston 212 latched in an axial range in which the valve port 218 is open.

These pistons and springs are, however, dimensioned and configured such that, at a sub-operational pressure lower than a threshold level (also referred to herein as a trigger pressure), the valve piston 212 is actuated to move axially downhole, overcoming elastic resistance of the closing spring 305, but a resultant hydraulic force on the stay piston 330 is not sufficient to overcome the stay spring 333. As a result, application of such a sub-operational or sub-threshold pressure for a period longer than a trigger interval causes axial downhole movement of the valve piston 212 (without obstruction by the now substantially stationary stay piston 330) far enough to allow entry of the latch pin 312 into the latch slot 512 (thus switching from the dormant mode to the active mode) or the allow the latch pin 312 to escape the latch slot (thus switching from the active mode to the dormant mode), as the case may be.

The controller components mentioned briefly above will now be described separately in more detail, whereafter cooperative behavior of the components of the example controller 148, in practice, are discussed.

Valve Piston Features

Figure 4A:
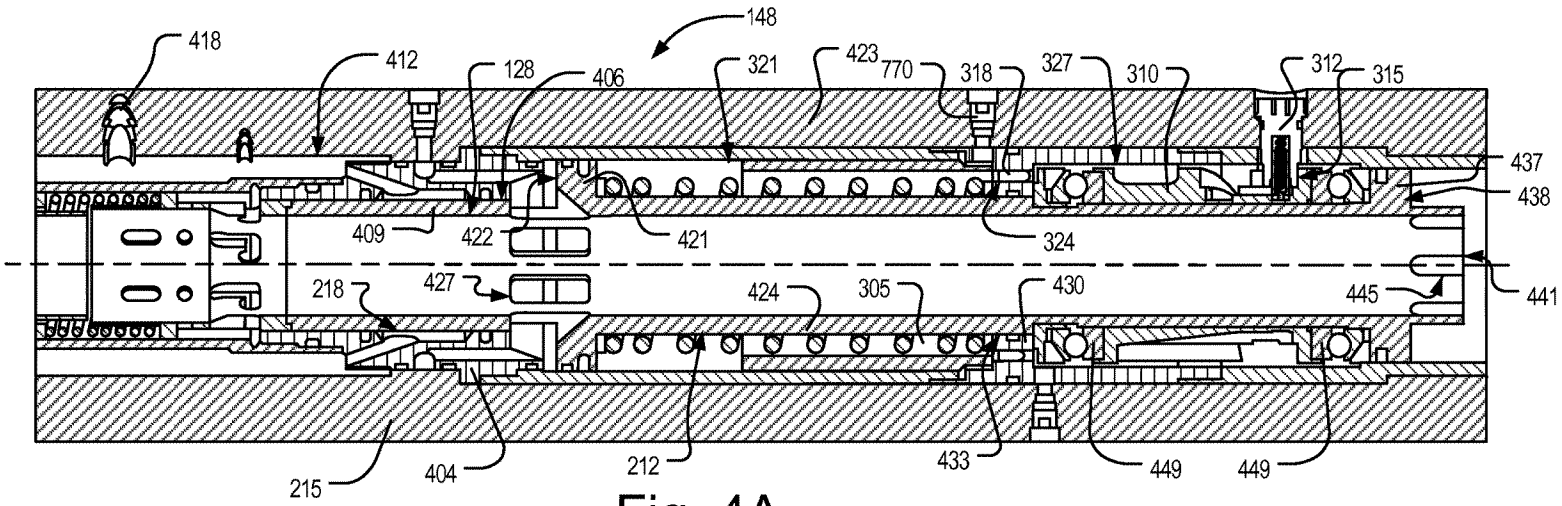
FIGS. 4A-4B depicts a longitudinal section of a part of the drilling apparatus of FIG. 2, on an enlarged scale, showing a valve piston of the drilling apparatus in an open condition and in a closed condition respectively.
Figure 4B:
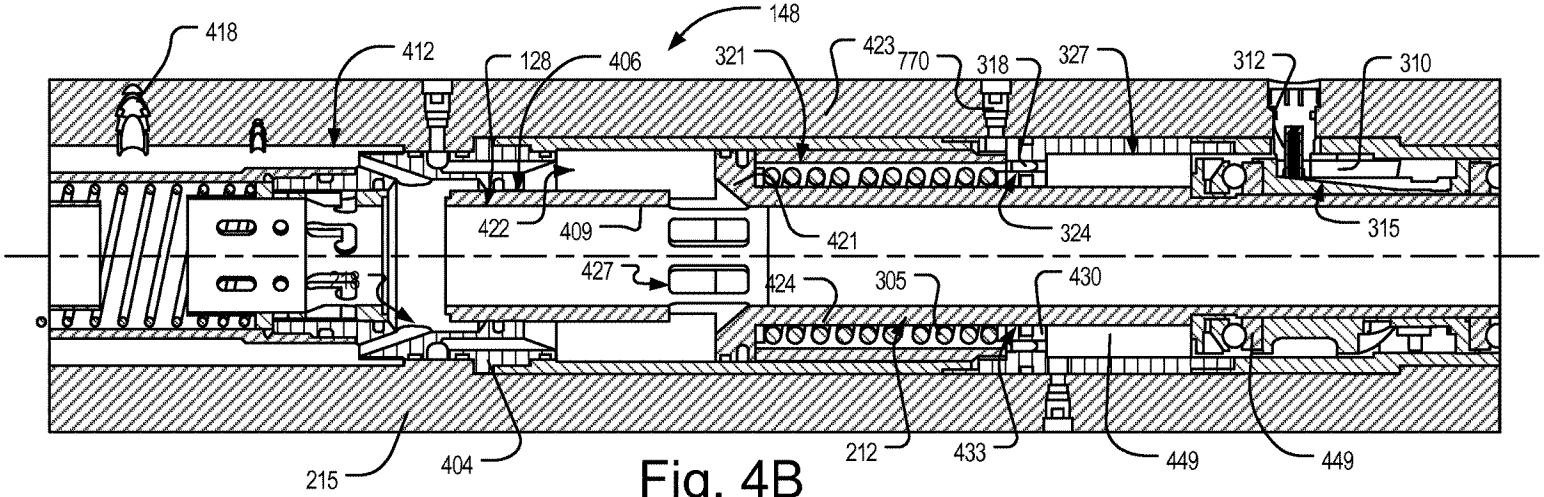

FIGS. 4A and 4B show views of the example controller 148 in the dormant and active modes respectively, in which some additional features of the example valve piston 212 are visible.

A valve port insert 404 is, in this example, mounted co-axially in the controller housing 215, defining a bore opening 406 in which a co-axial valve closure sleeve 409 provided by an uphole end portion of the valve piston 212 is sealingly received. The valve port insert 404 is anchored to the controller housing 215, with the valve closure sleeve 409 being axially slidable through the bore opening 406.

The valve port insert 404 defines the valve port 218 in the example form of a fluid flow channel that places a portion of the drill-string's bore 128 defined by the valve port insert 404 in communication with a substantially annular reamer actuation chamber 412. In its dormant mode position (FIG. 4A), the valve closure sleeve 409 closes the valve port 218, isolating the reamer actuation chamber 412 from the bore 128. When displaced axially downhole to its active-mode position (FIG. 4B), the uphole end of the valve piston 212 is clear of the valve port 218, so that the reamer actuation chamber 412 is in fluid flow communication with the bore 128 via the valve port 218, exposing the reamer actuation chamber 412 and therefore the reamer assembly 118 to bore pressure. The housing 215 includes one of more nozzles 418 to flush cuttings from the housing 215. Fluid ejection from the nozzles 418 may also as a surface pressure indicator to operators at the surface that tool activation has occurred. A relief valve (not shown) is provided between chamber 412 and the bore 128, serving as a failsafe measure in case the valve piston 212 the associated nozzles are clogged, trapping pressure below the drive piston. In such a case, the reamer arms can be forced down by pulling against a restriction hard enough to overcome the relief valve. Instead, or in addition, a relief valve may be provided between the chamber 412 and the annulus 134.

To the downhole side of the bore opening 406, the valve piston 212 has a radially projecting, circumferentially extending annular uphole collar or shoulder 421 that has a radially outer end edge in sealing, sliding engagement with an inner cylindrical surface of the controller housing 215's tubular wall 423. The valve piston 212 is thus co-axially slidable within the controller housing 215.

An annular space between a tubular central portion 424 of the valve piston 212 and the tubular wall 423 of the controller housing 215 provides, to a downhole side of the uphole shoulder 421, the control fluid reservoir 321.

The valve piston 212 has a circumferentially extending series of mud flow openings 427 positioned uphole of the shoulder 421, thus allowing fluid transfer between the bore 128 and an annular space extending radially between the cylindrical outer surface of the valve piston 212 and the tubular wall 423 of the controller housing 215, uphole of the uphole shoulder 421. Because fluid pressure in the control fluid reservoir 321 substantially matches annulus pressure (through operation of pressure balance mechanisms that will be discussed shortly), a pressure differential over the uphole shoulder 421 is substantial equal to the bore-annulus pressure differential. Typically, the higher of these pressures is on the uphole side of the uphole shoulder 421 (i.e., bore pressure), so that a net hydraulic force is exerted on the valve piston 212 in the downhole direction.

The controller housing 215 provides an annular chamber wall 430 that projects radially inwards from the controller housing's (215) tubular wall 423 at a position spaced downhole from the bore opening 406, axially beyond the uphole shoulder 421. The chamber wall 430 defines a cylindrical bore aperture 433 in which the valve piston 212 is slidingly received, a radially outer cylindrical surface of the valve piston 212 being in sealing engagement with a complementary mating radially inner edge surface of the chamber wall 430.

The chamber wall 430 thus sealingly bounds the control fluid reservoir 321 at an uphole end thereof. The chamber wall 430 is anchored against axial movement relative to controller housing 215. As a result, axial displacement of the valve piston 212 in the controller housing 215 changes the volume of the control fluid reservoir 321.

The closing spring 305 is located in the control fluid reservoir 321, being positioned co-axially about the central portion 424 of the valve piston 212 and acting between the uphole shoulder 421 and the chamber wall 430.

The valve piston 212 has a shoulder 437 adjacent its downhole end 441 analogous to the uphole shoulder 421, being annular and projecting radially to sealingly engage a radially inner cylindrical surface provided by the controller housing 215. The downhole shoulder 437 seals the draw chamber 327 at its downhole end. The draw chamber 327 is thus a substantially annular space defined radially between the valve piston 212 and a lining on the wall 423, and axially between the chamber wall 430 and the downhole shoulder 437. As mentioned, the draw chamber 327 is in fluid flow communication with the control fluid reservoir 321 via the flow control channel 324 having the flow restrictor 318.

Note that the draw chamber 327 is variable in volume responsive to axial displacement of the valve piston 212, increasing in volume upon downhole movement of the valve piston 212 (while the control fluid reservoir 321 decreases in volume), and vice versa.

The radially inner surface provided by the controller housing 215 is reduced at the downhole shoulder 437, when compared to the uphole shoulder 421, so that an axial end face 438 of the downhole shoulder 437 exposed in use to drilling fluid pressure in the bore 128 is smaller in area than an axial end face 422 of the uphole shoulder 421 exposed to substantially the same bore pressure. This difference facilitates downhole movement of the valve piston 212 responsive to differences between the bore pressure and the annular pressure.

The downhole end of the valve piston 212 defines a stub that projects axially beyond the downhole shoulder 437 and has a circumferentially extending series of holes 445. These holes 445 serve to permit radial fluid flow to and from the interior of the valve piston 212 even when the valve piston 212 is in end-to-end abutment with the stay piston 330.

Barrel Cam Features

As mentioned, the controller 148 according to this example embodiment includes a barrel cam 310 that is mounted co-axially in the valve piston 212. In the embodiment illustrated in FIG. 4, the barrel cam 310 is anchored to the valve piston 212 for axial movement therewith by being sandwiched by two axially spaced ball bearings 449 (FIG. 4) that are mounted for axial movement with the valve piston 212. By operation of the bearings 449, the barrel cam 310 is free to rotate relative to the valve piston 212 about the longitudinal axis.

Figure 5A:
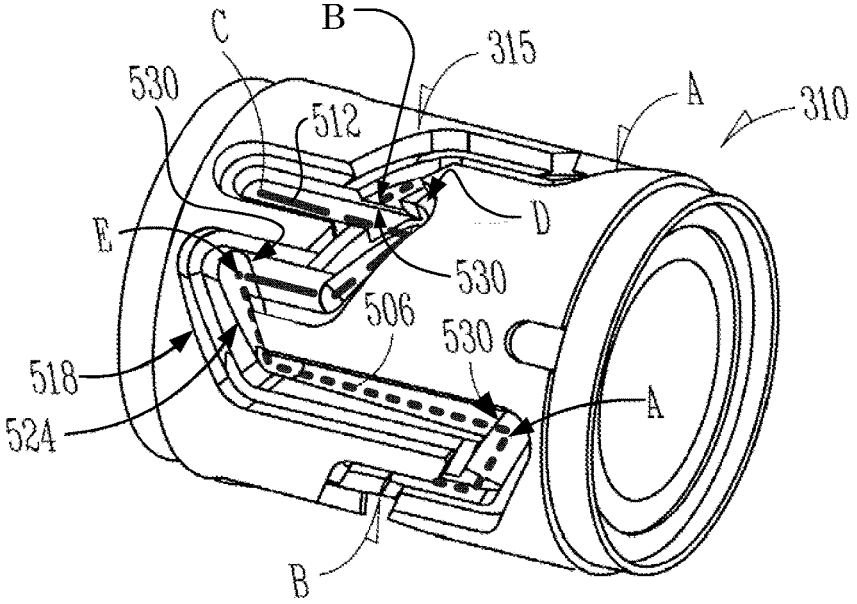
FIGS. 5A and 5B depict three-dimensional views of a barrel cam to form part of a drilling apparatus of FIG. 2, according to an example embodiment.
Figure 5B:
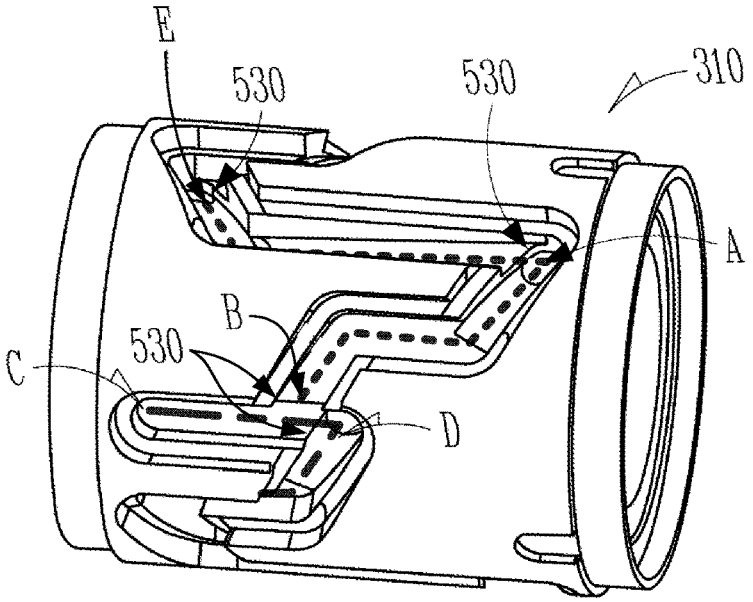
Figure 6:
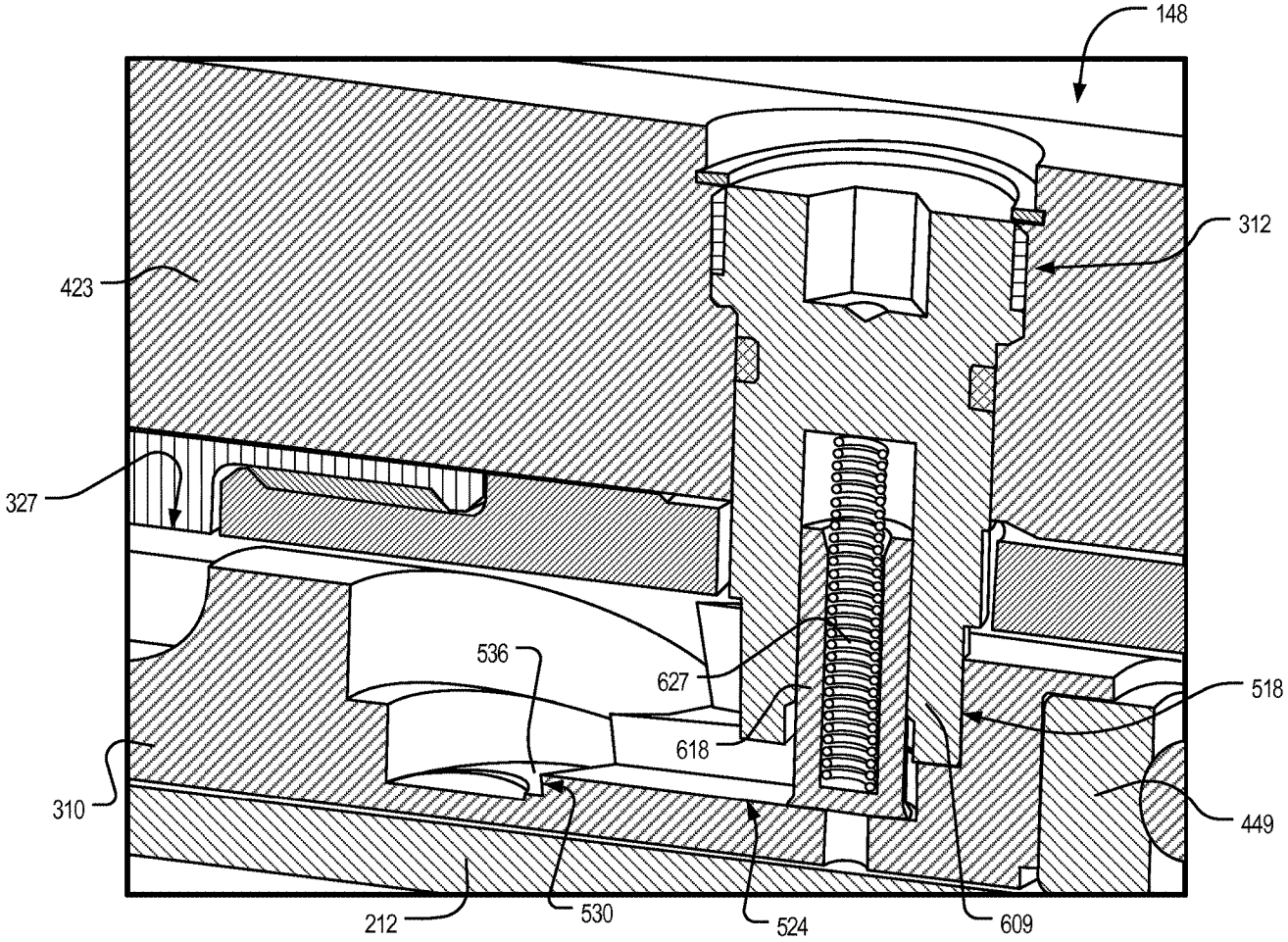
FIG. 6 depicts a longitudinally sectioned three-dimensional view of part of the drilling apparatus of FIG. 2, on an enlarged scale, showing details of a latch pin and barrel cam forming part of the drilling apparatus according to an example embodiment.

Turning now to FIGS. 5 and 6, it can be seen that a radially outer cylindrical surface of the example barrel cam 310 defines the track 315 that cooperates with the latch pin 312 in a cam/follower arrangement. The track 315 comprises an endless guide recess 518 that has a substantially even depth, extending circumferentially around the barrel cam 310, but varying in axial positions that can be occupied by the latch pin 312. The track 315 further comprises a locking channel 524 having a path identical to that of the guide recess 518, but having a smaller width and a greater depth. Described differently, the locking channel 524 is an elongate slot-like cavity in a floor of the guide recess 518.

The latch pin 312 in this example comprises a follower pin 609 that is mounted in the tubular wall 423 of the controller housing 215 to project radially inwards into the guide recess 518 with sliding clearance to bear against sidewalls of the guide recess 518 for translating axial movement of the valve piston 212 to rotary movement of the barrel cam 310.

The latch pin 312 further comprises a catch pin 618 housed co-axially in a blind socket in the follower pin 609. The catch pin 618 is telescopically slidable relative to the follower pin 609, projecting radially inwards from the radially inner end of the follower pin 609. The catch pin 618 is spring-loaded, being urged by a latch spring 627 away from the follower pin 609 to bear against a floor of the locking channel 524.

Unlike the guide recess 518, the locking channel 524 varies in depth along its length. Such depth variations include sudden depth changes at a number of latch steps 530, and gradual depth changes at which the floor of the locking channel 524 are inclined to form ramps 536 that act as cam surfaces that causes radial raising or lowering of the catch pin 618 when the follower pin 609 moves along the track 315.

In FIG. 5A, a portion of the track 315 that within which the latch pin 312 may be held captive to latch the controller 148 in the active condition (referred to herein as a latch slot) is generally indicated by chain-dotted line 512. Those portions of the track 315 corresponding to the dormant mode (referred to herein as an unlatch slot) are indicated in FIG. 5 by dotted line 506.

Note that an extreme downhole point of the unlatch slot 506 (point A) is located such that the valve piston 212 closes the valve port 218 when the latch pin 312 is at point A. When the latch pin 312 is at point A, it cannot move along the unlatch slot 506 to point E due to a step 530 on which the catch pin 618 fouls. Instead, downhole movement of the valve piston 212 causes movement of the barrel cam 310 such that the latch pin 312 moves along the unlatch slot 506 from point A to point B. Portion AB of the unlatch slot 506 defines a ramp 536 that pushes the catch pin 618 radially outwards.

If the latch pin 312 passes point B, it enters the latch slot 512 and cannot return to leg AB due to the step 530 at point B. The latch slot 512 has an extreme downhole position (point D) that is significantly short of point A, corresponding to a valve piston 212 position in which the valve port 218 is open. The latch slot 512 in this example comprises two portions (leg C-D and leg D-E), separated by a step 530 at point D. The floor of the locking channel 524 is inclined to provide ramps 536 from point C to point D, and from point D to point E. Another step 530 at point E prevents reentry of the latch pin 312 into the latch slot 512 once it has escaped the latch slot 512 by reaching point E, having then entered the unlatch slot 506 and being movable axially along the unlatch slot 506 from point E to point A.

Note that one cycle of the track 315 (e.g., from point A to point A) comprises only one third of the circumference of the barrel cam 310. The described cycle thus repeats three times, in this example, and the barrel cam 310 cooperates with three latch pins 312 at 120 degree intervals. See in this regard, e.g., FIGS. 8A-8G, in which the wall 423 is angularly sectioned to reveal two of the latch pins 312.

Stay Piston Features

Figure 7:
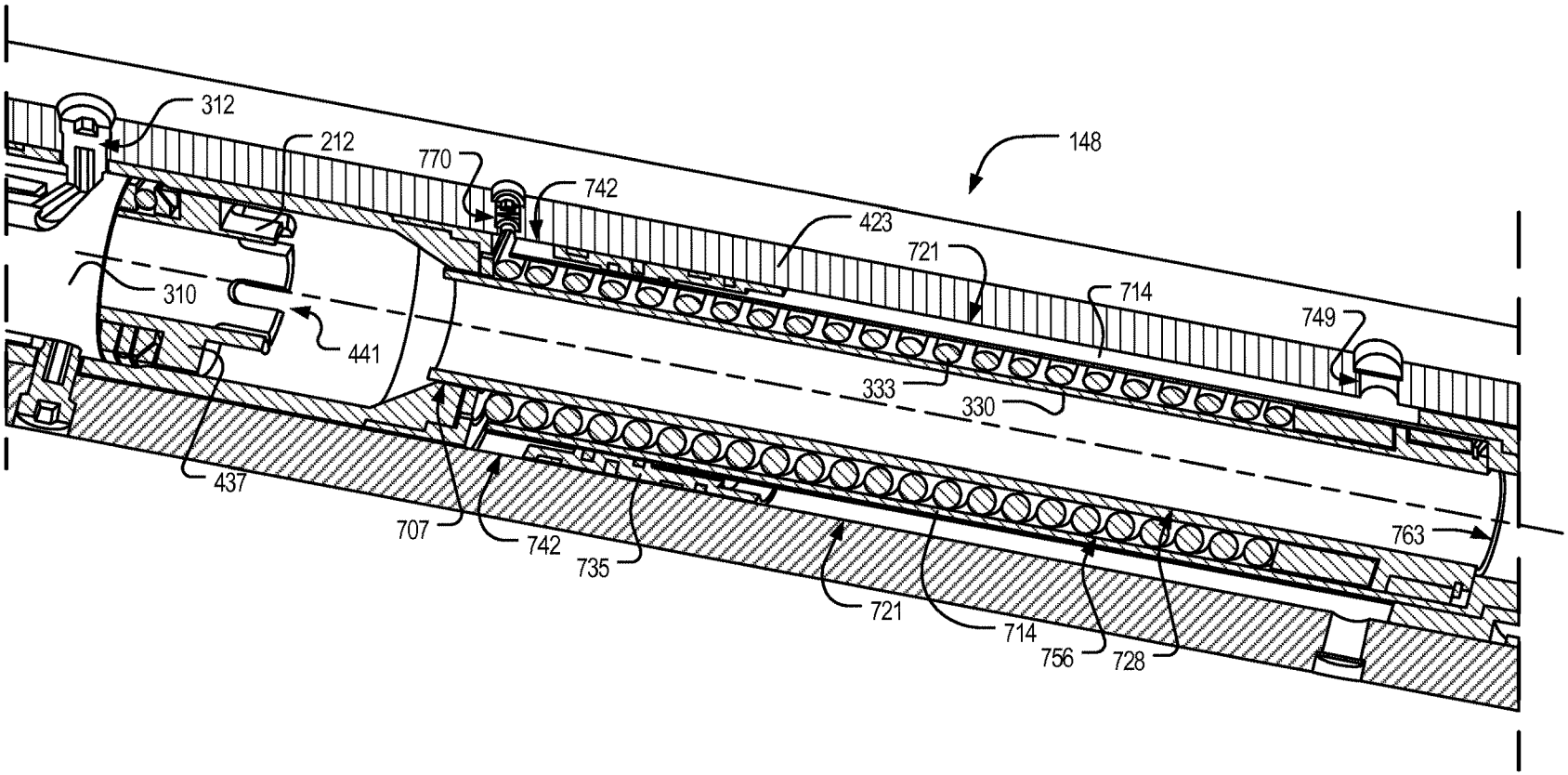
FIG. 7 depicts a three-dimensional longitudinal section of a part of the drilling apparatus of FIG. 2, on an enlarged scale, showing details of a stay piston of the drilling apparatus according to an example embodiment.

In FIG. 7, a stay piston according to an example embodiment is indicated by reference numeral 330. The example stay piston 330 is a hollow cylindrical member that is co-axially mounted in the controller housing 215. The stay piston 330 extends slidably through a constriction 707 in bore 128, being a sealed sliding fit in the constriction 707. Similar to the valve piston 212, a cylindrical passage 728 defined by the interior or the stay piston 330 is in-line with the bore 128 of the drill string 108, so that the passage 728 defines the bore 128 for the portion thereof coinciding with the stay piston 330.

The stay piston 330 is housed in a sleeve 714 co-axial with it. A tubular wall of the sleeve 714 is radially spaced both from the stay piston 330 and from an internal radially inner cylindrical surface of the controller housing wall 423, defining an annular cylindrical cavity 756 between the stay piston 330 and the sleeve 714, and defining between the sleeve 714 and the controller housing wall 423 an annular cylindrical cavity comprising an exposure chamber 721 and an equalization chamber 742 that are sealingly isolated from each other by a pressure balance piston 735.

The pressure balance piston 735 seals against the outer cylindrical surface of the sleeve 714 and against the inner cylindrical surface of the tubular housing wall 423, being axially slidable on the sleeve 714 to alter volumes of the exposure chamber 721 and the equalization chamber 742 in sympathy with one another. The equalization chamber 742 is in communication with the housing cavity 756 through holes in the sleeve 714 adjacent an uphole end of the sleeve 714 at the constriction 707. The stay spring 333 is co-axially mounted in the housing cavity 756, urging the stay piston 330 axially away from the constriction 707.

In this example, the equalization chamber 742 and the housing cavity 756 communicating therewith (effectively forming a single volume) is filled with a control fluid in the example form of oil.

The tubular wall 423 of the controller housing 215 defines a radially extending passage that provides an annulus opening 749. The annulus opening 749 places the exposure chamber 721 in fluid flow communication with the annulus 134, so that the exposure chamber 721 is in practice filled with drilling fluid (e.g., drilling mud), at fluid pressure values substantially equal to annulus pressure.

Because the pressure balance piston 735 is substantially free to move axially along the sleeve 714 responsive to hydraulic forces acting thereon, the pressure balance piston 735 dynamically adjusts its axial position to equalize fluid pressures between the exposure chamber 721 and the equalization chamber 742. As a result, oil pressure in the equalization chamber 742 (and therefore also in the housing cavity 756) is kept substantially equal to annulus pressure.

The equalization chamber 742 is in oil flow communication with the control fluid reservoir 321 (see FIG. 4) by an oil passage 770 in the housing wall 423, the oil passage 770 having openings to the control fluid reservoir 321 and the equalization chamber 742 (FIG. 7) respectively. The oil passage 770 serves to maintain the control fluid reservoir 321 substantially at annulus pressure.

Note that the control fluid reservoir 321, the draw chamber 327, the equalization chamber 742, and the housing cavity 756 are interconnected volumes holding control fluid (e.g., oil) that is automatically kept substantially at annulus pressure through operation of the balance piston 735, which is exposed to drilling fluid at annulus pressure in the exposure chamber 721. Remaining volumes in the interior of the controller 148 in operation hold drilling fluid, generally substantially at bore pressure.

The stay piston 330 has axial end face 763 at its downhole end. At high fluid pressure levels, the stay piston 330 is urged uphole (i.e., leftward in FIG. 7) against the bias of the stay spring 333 due to a pressure differential between the bore 128 and the housing cavity 756.

Example Controller Operation

An example sequence of operation of the controller 148 and the reamer assembly 118 is illustrated with reference to FIGS. 8A-8G.

Figure 8A:
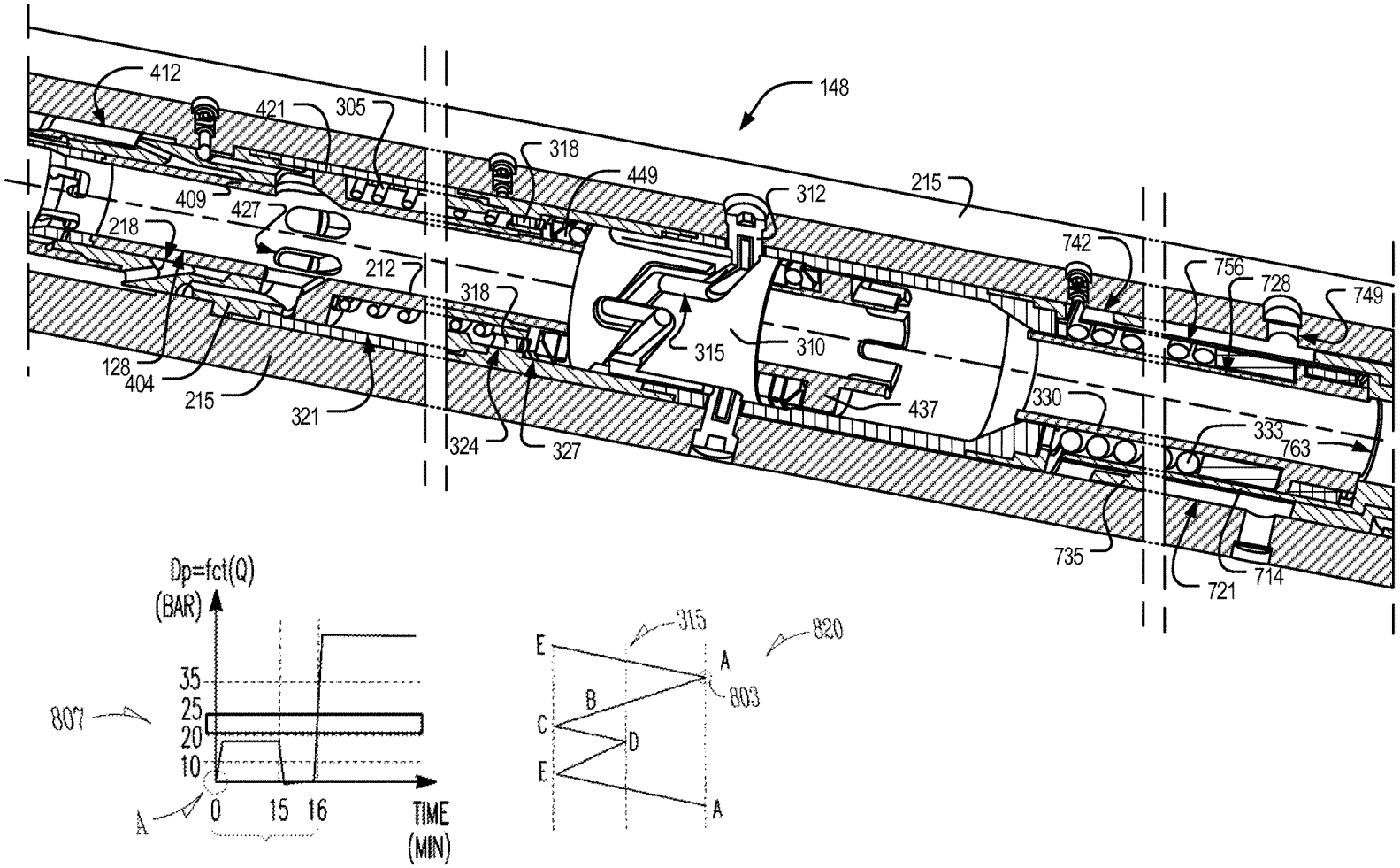
FIGS. 8A-8G each show a three dimensional longitudinal section of the drilling apparatus of FIG. 2 at various stages during controlled operation of the drilling apparatus, together with a pressure graph and a latch pin travel diagram corresponding to the condition of the associated longitudinal section, according to an example embodiment.

In FIG. 8A the controller 148 is shown initially to be in the dormant condition. Pressure graph 807 schematically shows bore-annulus pressure difference values over time. At first, drilling fluid in the bore 128 is not pressurized, so that the bore-annulus pressure difference is substantially zero.

In the absence of an effectively non-zero bore-annulus pressure difference, the valve piston 212 experiences no hydraulic actuation, and is urged by the closing spring 305 uphole (i.e., leftwards in FIG. 8A). Being in the dormant condition, the latch pin 312 is located in the unlatch slot 506. Due to operation of the closing spring 305, the latch pin 312 is located at point A, the valve piston 212 thus being at an extreme uphole position in which the valve closure sleeve 409 closes the valve port 218.

Diagram 820 in FIGS. 8A-8G schematically indicates travel of the latch pin 312 along the track 315. Points A to E in diagram 820 corresponds to points A to E of the track 315 described with reference to FIG. 5. Pin position indicator 803 schematically indicates location of the latch pin 312 at point A in the unlatch slot 506.

Figure 8B:
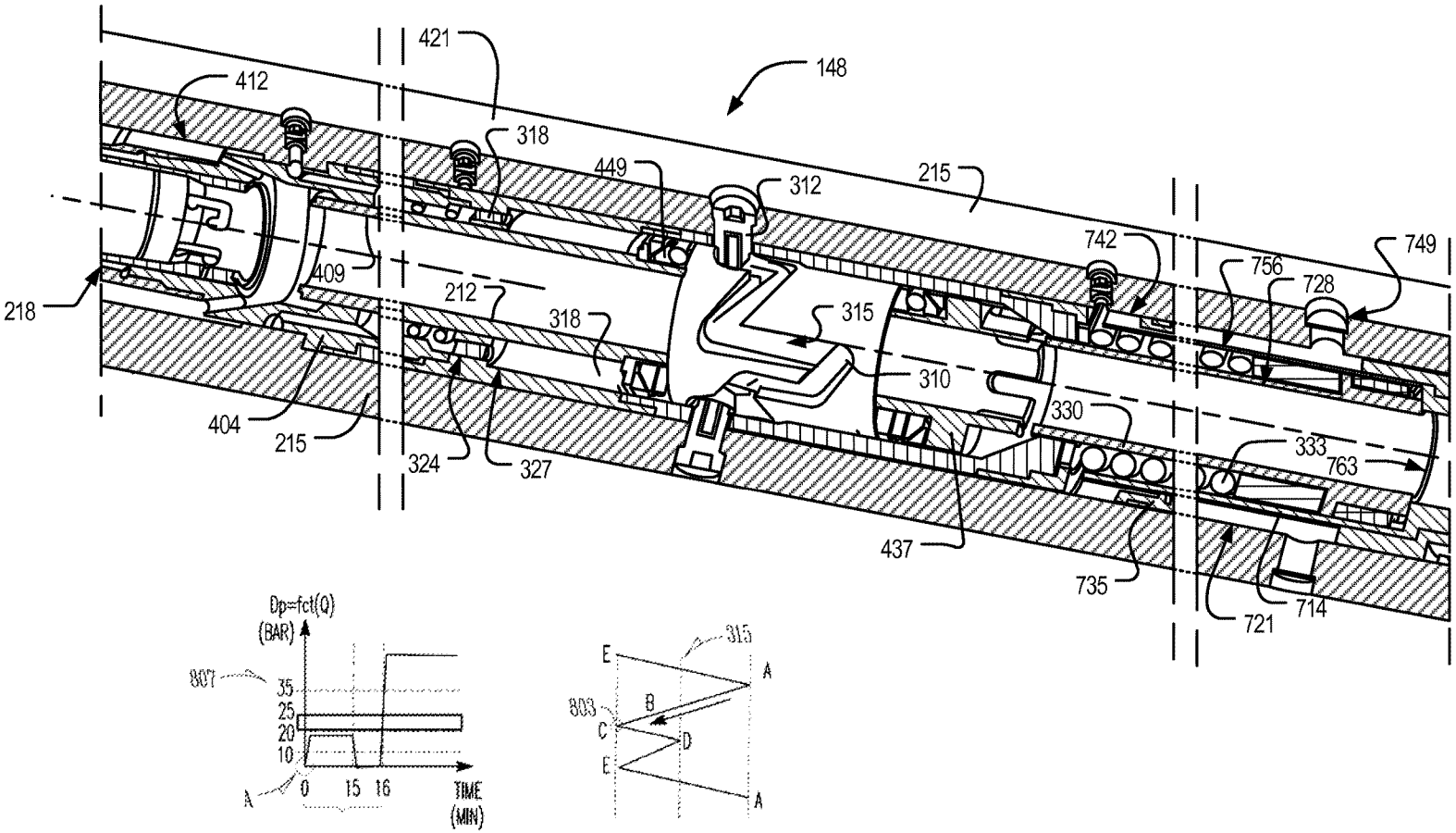
Figure 8C:
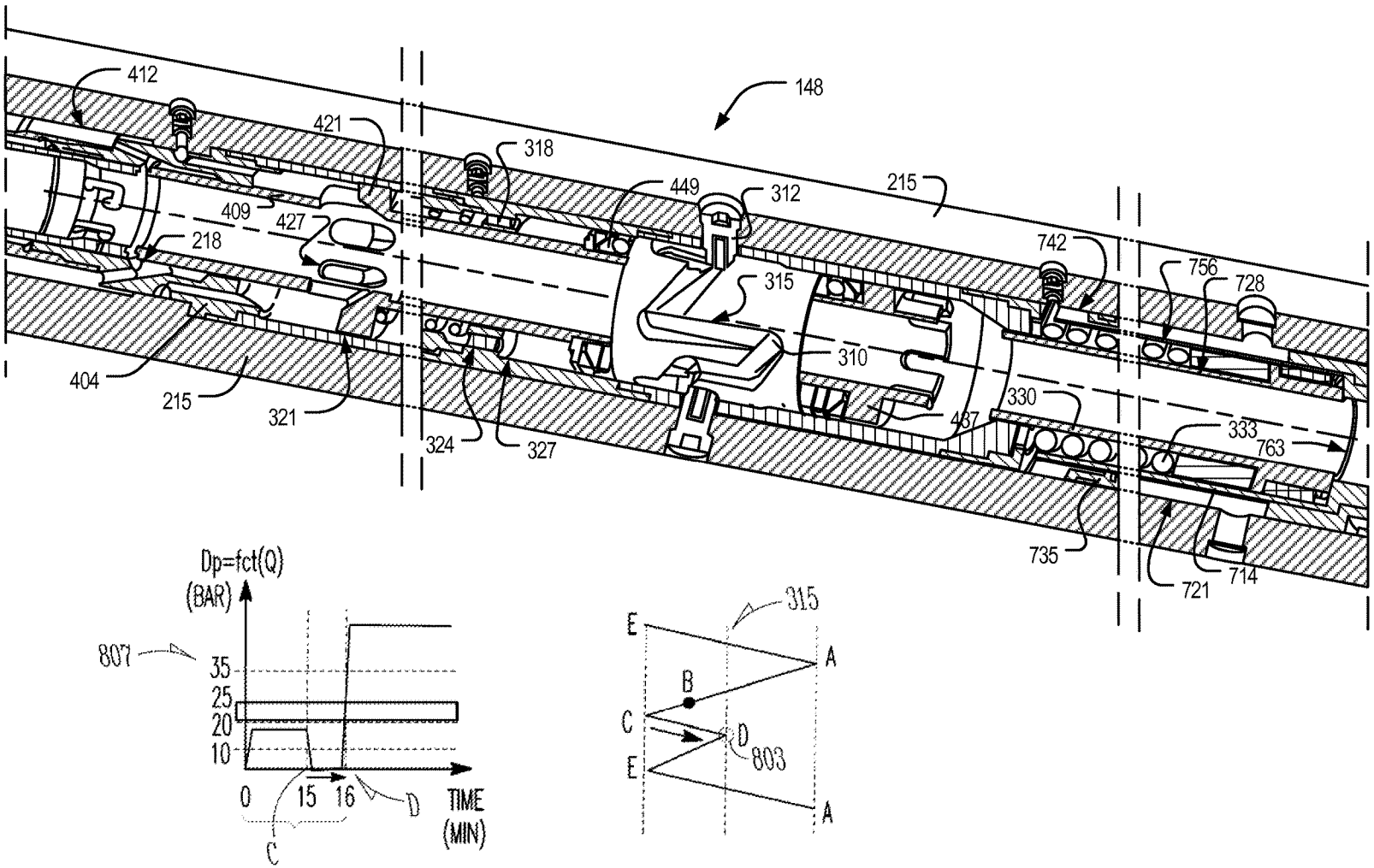

FIG. 8B shows the provision of fluid pressure conditions to change the controller 148 from the dormant condition to the active condition. In this example, drilling fluid control to switch to the active condition comprises maintaining a bore-annulus pressure difference below a trigger threshold value of about 20 bar for at least a trigger threshold interval of about 15 minutes.

The various components of the controller 148 (e.g., the hydraulic features of the valve piston 212 and the stay piston 330, and the parameters of the closing spring 305 and the stay spring 333) are selected such that below a bore-annulus pressure difference of 20 bar (being the trigger threshold value), net hydraulic forces on the stay piston 330 is insufficient to move the stay piston 330 uphole (i.e., leftwards in FIG. 8B) while net hydraulic forces on the due to the bore-annulus pressure difference is greater than a maximum resistive force that can be exerted thereon by the closing spring 305, so that the valve piston 212 is hydraulically actuated to move longitudinally downhole (i.e., rightwards in FIG. 8B).

The valve piston 212's downhole movement is retarded by operation of the flow restrictor 318 that limits the rate of fluid transfer from the control fluid reservoir 321 across the chamber wall 430 to the draw chamber 327. The latch pin 312 thus moves from point A to point C, entering the latch slot 512 at point B. Note that the latch mechanism of the control arrangement provided by the controller 148 is changed from the dormant mode to the active mode when the latch pin 312 reaches point B, entering the latch slot 512. Thus, point B in this instance comprises a mode change position of the latch pin 312, with a corresponding longitudinal position of the valve piston 212 comprising a mode change position of the valve piston 212.

Note further that cessation of the bore-annulus pressure difference before the latch pin 312 reaches point B in the track 315 would result in return of the latch pin 312 to point A due to uphole movement of the valve piston 212 under the urging of the closing spring 305.

After provision of the mode switching pressure conditions illustrated in FIG. 8B, pumping of drilling fluid through the bore 128 may be ceased for at least a predefined interval. Note, again, that the valve piston 212 is urged towards its closed position in the absence of a bore-annulus pressure difference by the closing spring 305.

In the example, provision of a substantially zero bore-annulus pressure difference for a pressure cessation interval of about one minute (see pressure graph 807 in FIG. 8C) is sufficiently long to move the valve piston 212 to an extreme uphole position achievable by the valve piston 212 in the latched condition. This extreme uphole latched position corresponds to location of the latch pin 312 at point D (see the condition of the controller 148 shown in FIG. 8C. When the latch pin 312 reaches point D in the track 315, it passes the step 530 at that point and abuts against the walls of the track 315, resisting further uphole movement of the valve piston 212 under the bias of the closing spring 305. Due to abutment also against the step 530 at point D, the only available movement for the latch pin 312 from point D is along leg DE of the latch slot 512.

Note that when the latch pin 312 is at point D in the track 315, the valve closure sleeve 409 is clear of the valve port 218, exposing the reamer assembly 118 to bore pressures. The latch pin 312's only path of escape from the latch slot 512, to permit closing of the valve port 218 is to reach point E (comprising a mode change position) along leg DE, to thereafter enable sufficient uphole movement of the valve piston 212 (e.g., for the latch pin 312 to again approach point A). As will presently be seen, however, downhole movement of the valve piston 212 is obstructed or stopped by the stay piston 330 if the movement of valve piston 212 is under hydraulic actuation due to a bore-annulus pressure difference greater than the trigger threshold value.

Figure 8D:
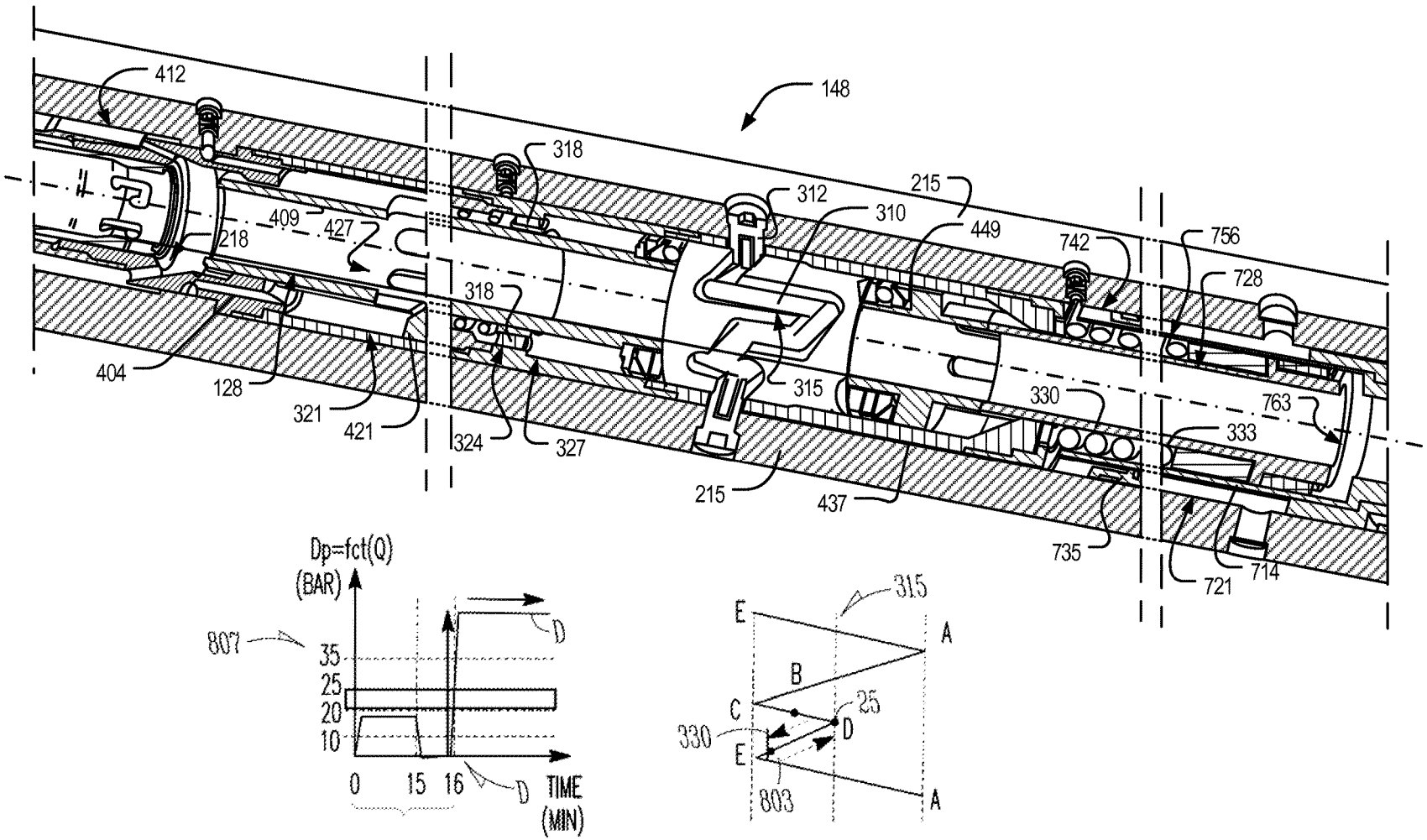

FIG. 8D shows and example instance where the bore-annulus pressure difference is ramped up beyond the trigger threshold value of between 20 and 25 bar of the present example. As schematically shown along leg DE of the track 315 in the track diagram of FIG. 8D, the stay piston 330 moves uphole (leftwards in FIG. 8D) under hydraulic actuation faster than the valve piston 212 moves downhole (rightwards in FIG. 8D), meeting the valve piston 212 in end-to-end abutment therewith before the latch pin 312 has reached the mode change position of point E. The controller 148 of FIG. 8D is shown in a condition shortly before the stay piston 330 stops the valve piston 212. When the stay piston 330 and the valve piston 212 come into end-to-end abutment, the valve piston 212 is shunted uphole by the stay piston 330, thus keeping the latch pin 312 in the latch slot 512 and moving the latch pin 312 back towards point D.

The stay piston 330 thus serves to block escape of the latch pin 312 from the latch slot 512 responsive to pressure conditions in which the bore-annulus pressure difference exceeds the trigger threshold value. Thus, the described latch mechanism and the stay piston 330 serve to dispose the controller 148 in the active condition, because the valve port 218 remains open regardless of the application of operational bore pressures (at which the bore-annulus pressure difference exceeds the trigger threshold value), the latch pin 312 being trapped in the latch slot 512. The result is that the reamer assembly 118 automatically deploys responsive to the application of operational bore pressures.

Note that even though the stay piston 330 is hydraulically actuated uphole against a greater spring resistance (providing by the stay spring 333) than the spring resistance (provided by the closing spring 305) experienced by the valve piston 212, the superior rapidity of the stay piston's (330) hydraulically actuated uphole movement is enabled by retardation of movement of the valve piston 212 by operation of the flow restrictor 318, as previously described.

Figure 8E:
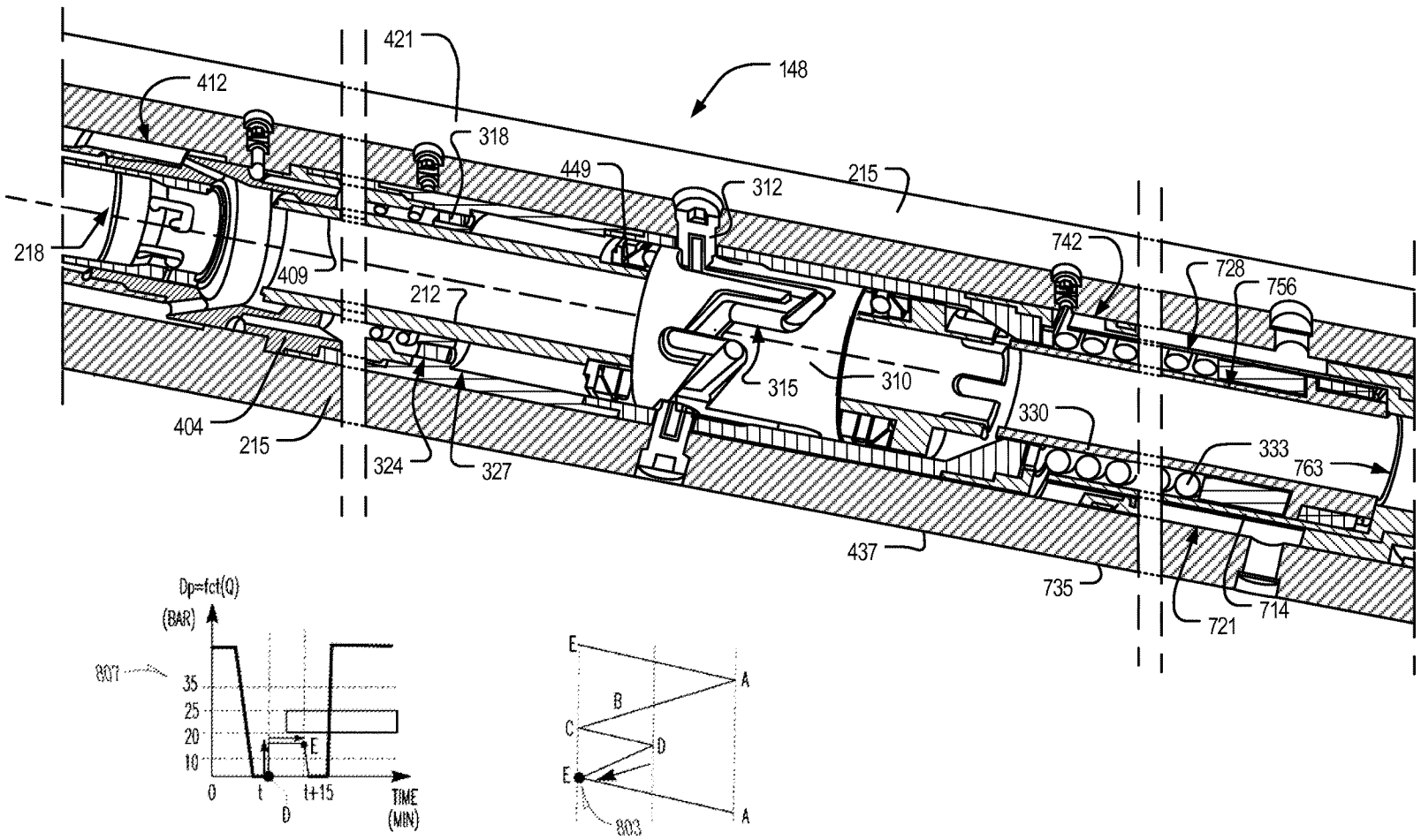

Escape of the latch pin 312 from the latch slot 512 is achievable only by provision of predefined mode change fluid pressure conditions. In this example, the mode change fluid pressure conditions to change from the active mode to the dormant mode are similar to those for changing from the dormant mode to the active mode. FIG. 8E shows pressure conditions controlled by an operator or automated system at the surface control system 140.

In this example, the bore pressure is selectively changed to provide a bore-annulus pressure difference below the trigger threshold value (here, for example, on the order of 20-25 bar) for at least a trigger threshold interval, again being about 15 minutes. As before, the stay piston 330 remains stationary in its rest position in which it clears the valve piston's 212 path to allow movement of the valve piston 212 to a mode change position corresponding to escape of the latch pin 312 from the latch slot 512 by passage of the latch pin 312 over the step 530 at point E. As is the case with each of points A-D, point E is effectively a point of no return for the latch pin 312 along the latch slot 512 due to fouling of the catch pin 618 on the corresponding step 530. Thus, when the latch pin 312 reaches point E, it is trapped in the unlatch slot 506 being movable from point E only along leg E-A of the track 315 towards point A. Note that the controller 148 is changed from the active condition to the dormant condition when the latch pin 312 enters the unlatch slot 506 at point E.

Figure 8F:
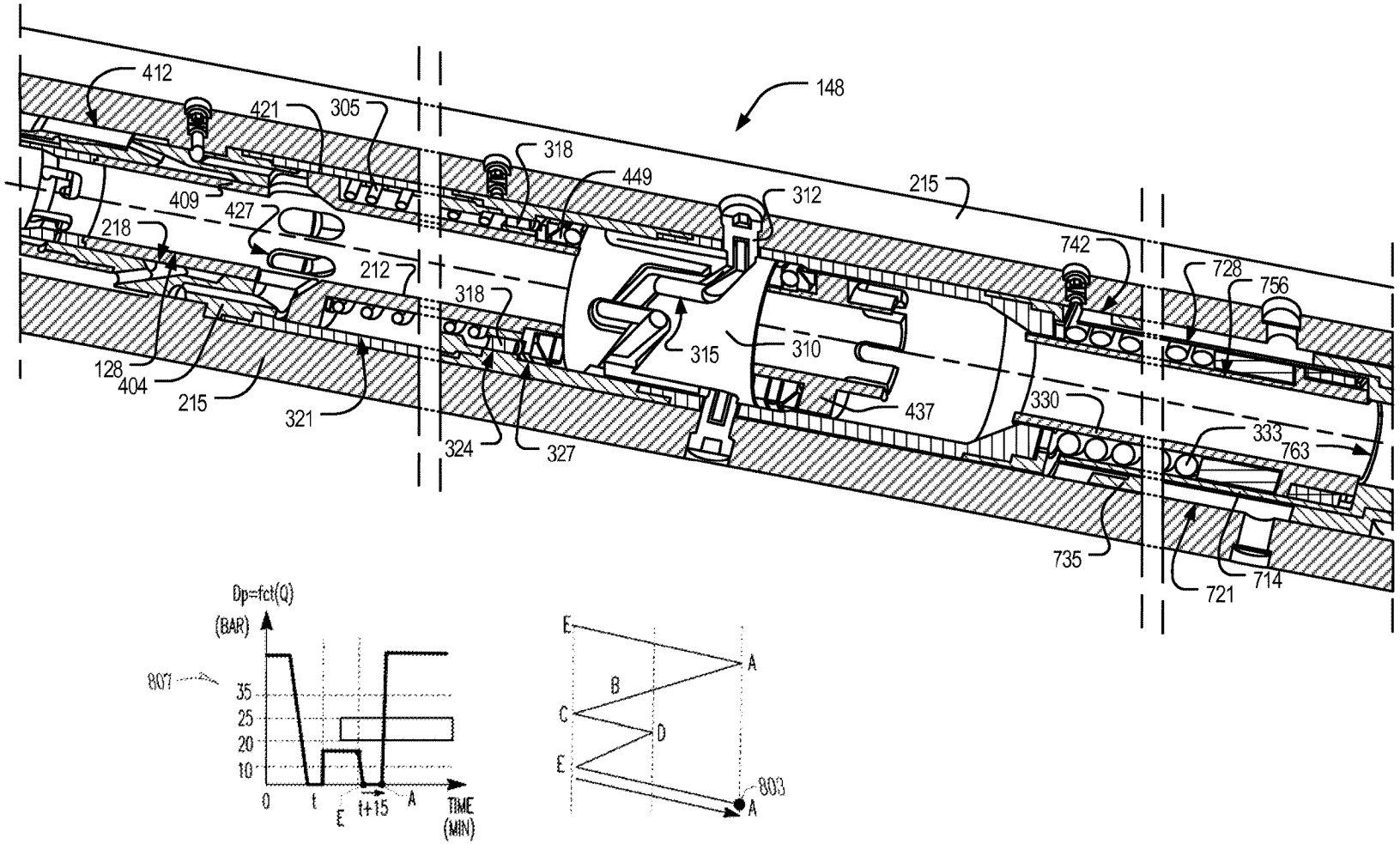

Once the latch pin 312 is in the unlatch slot 506, the valve piston 212 is free to move longitudinally uphole either under the urging of the closing spring 305 (in the absence of bore-annulus pressure difference) or by being shunted uphole by the stay piston 330 (at high bore-annulus pressure difference values), so that the latch pin 312 moves from point E back to the starting position (point A), as shown schematically in FIG. 8F. In this example, the operator provides a bore-annulus pressure difference at or near zero bar after the 15 minute mode-switching low pressure interval (see FIG. 8E), resulting in automatic spring-actuated movement of the valve piston 212 uphole to its extreme uphole position in the unlatched condition (point A), to close the valve port 218.

Figure 8G:
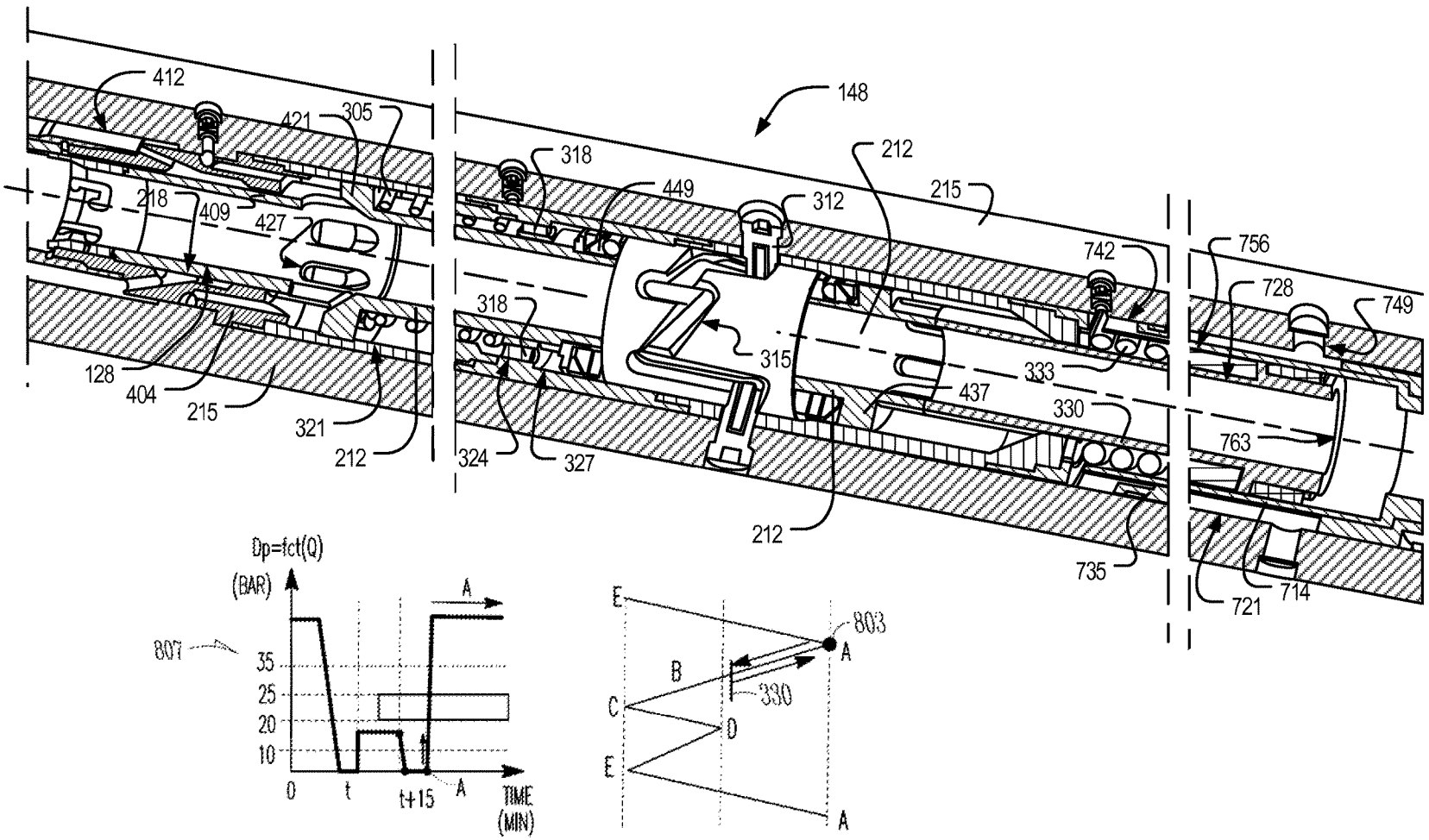

FIG. 8G shows operation of the stay piston 330 to keep the latch pin 312 in the unlatch slot 506 responsive to application of bore-annulus pressure differences above the trigger threshold value. When such a high operational pressure, at which the respective downhole tool is deployed (referred to herein as operational tool pressures), is applied, the stay piston 330 moves uphole (also referred to herein as the first longitudinal direction) under hydraulic actuation faster than valve piston 212 moves downhole (also referred to herein as the second longitudinal direction), to abut end-to-end against the valve piston 212 before it reaches the mode change position defined by point B. In this example, the valve piston 212 is stopped before the valve port 218 is opened. Thus, the controller 148 is in the dormant mode, the reamer assembly 118 being unresponsive to operational bore pressures.

By the above-described methods and systems, control of downhole tool exclusively through control of bore pressure is achieved. It is a benefit that, once the controller 148 is in the active mode, the reamer assembly 118 (or any other downhole tool that may be connected to the controller 148 instead) may be deployed and retracted repeatedly simply by ramping up bore pressure. In the dormant mode, drilling fluid pressures can be provided as required, without concern for inadvertent deployment of the relevant tool, e.g. the reamer assembly 118, because accidental application of the described mode switching bore conditions (e.g., continuous low flow/pressure for 15 minutes or more) is unlikely.

Thus, a method and system control downhole tool activation by remote fluid pressure control have been described. Some embodiments provide a drilling apparatus a generally tubular housing to form an in-line part of an elongated drill string extending longitudinally along a borehole, the housing defining a longitudinally extending bore to convey drilling fluid under pressure, a bore-annulus pressure difference being defined between drilling fluid pressure in the bore and drilling fluid pressure in an annulus that radially spaces the housing from a borehole wall. A control arrangement may be mounted in the housing to control response of a downhole tool in the drill string to variations in the bore-annulus pressure difference, the control arrangement defining a valve port that is connectable to a hydraulic activation mechanism of the downhole tool (e.g., reamer assembly 118), the control arrangement further comprising a valve piston that is longitudinally displaceable in the housing to dispose the valve port between an open condition, to permit fluid pressure communication between the bore and the activation mechanism of the downhole tool, and a closed condition, to substantially isolate the activation mechanism from the bore. The example apparatus further comprises a latch mechanism (including, e.g., barrel cam 310 and latch pin 312) to releasably latch the valve piston to the housing to restrain relative longitudinal movement of the valve piston in a first longitudinal direction (e.g., in the uphole direction, towards closure of the valve port), the valve piston, when latched, being releasable by movement thereof in an opposite, second longitudinal direction (e.g., in the downhole direction) to a mode change position (e.g., by the latch pin 312 reaching mode change point E on the barrel cam 310, point B being a mode change position when valve piston 212 is unlatched). In this embodiment, latching or release of the valve piston changes an operational mode of the control arrangement between an active mode in which the valve port in its open condition upon application of bore pressures at or above tool activation levels, to permit hydraulic tool activation, and a dormant mode in which the valve port in its closed condition upon application of bore pressures at or above tool actuation levels, to prevent hydraulic tool activation. The example drilling apparatus further comprises a stay member (e.g., stay piston 330) that is automatically displaceable under hydraulic actuation responsive to provision of the bore-annulus pressure difference above a trigger threshold value, to obstruct movement of the valve piston, when latched, under hydraulic actuation to the mode change position.

Although the present invention has been described with reference to specific example embodiments, it will be evident that various modifications and changes may be made to these embodiments without departing from the broader spirit and scope of method and/or system. Accordingly, the specification and drawings are to be regarded in an illustrative rather than a restrictive sense.

For example, staying mechanisms different from the stay piston 330 may be employed to obstruct movement of the valve piston 212, in some embodiments. Note also that although the described control arrangement finds particularly beneficial application in combination with a reamer assembly, these techniques can profitably be employed in combination with a variety of other downhole tools, including, for example, adjustable gage stabilizers, jars, dump valves, valves, packers, flow control devices or any hydraulically actuated mechanism in which its state needs to be controlled at will from surface.

The described example embodiments therefore disclose, inter alia, a well tool apparatus to control a downhole tool in a drill string which will extend longitudinally along a borehole, the well tool apparatus comprising a generally tubular housing configured to form an in-line part of the drill string, the housing defining a longitudinally extending bore to convey drilling fluid under pressure, a bore-annulus pressure difference being defined between drilling fluid pressure in the bore and drilling fluid pressure in an annulus that radially spaces the housing from walls defining the borehole; and a control arrangement mounted in the housing, the control arrangement being configured to control response of the downhole tool in response to variations in the bore-annulus pressure difference, the control arrangement defining a valve port that is connectable to a hydraulic activation mechanism of the downhole tool.

The control arrangement comprises: a valve piston that is longitudinally displaceable in the housing to dispose the valve port between an open condition which permits fluid pressure communication between the bore and the activation mechanism of the downhole tool, and a closed condition which substantially isolates the activation mechanism from the bore; and a latch mechanism configured to releasably latch the valve piston to the housing to restrain relative longitudinal movement of the valve piston in a first longitudinal direction, wherein the latched valve piston is releasable by movement thereof in an opposite, second longitudinal direction to a mode change position in which the an operational mode of the control arrangement changes between, on the one hand, an active mode in which the valve port is in an open condition upon application of bore pressures at or above tool activation levels, to permit hydraulic tool activation, and, on the other hand, a dormant mode in which the valve port is in a closed condition upon application of bore pressures at or above tool activation levels, to prevent hydraulic tool activation.

The control arrangement further comprises a stay member that is automatically displaceable under hydraulic actuation responsive to provision of the bore-annulus pressure difference above a trigger threshold value, to obstruct movement of the latched valve piston under hydraulic actuation to the mode change position.

The stay member may be a stay piston longitudinally aligned with the valve piston and being longitudinally displaceable under hydraulic actuation in the first longitudinal direction, towards engagement with the valve piston. In such a case, the control arrangement may further comprise a closing bias arrangement configured to urge the valve piston in the first longitudinal direction, towards closure of the valve port and against hydraulically actuated movement of the valve piston, and a staying bias arrangement configured to urge the stay member in the second longitudinal direction, away from the valve piston and against hydraulically actuated movement of the valve piston, the staying bias arrangement exerting a greater biasing force than the closing bias arrangement and being selected such that there is a range of bore-annulus pressure difference values at which hydraulically actuated movement of the stay piston is substantially prevented by the staying bias arrangement, while achieving hydraulically actuated movement of the valve piston against the closing bias arrangement.

The well tool apparatus may further comprise a retarding arrangement to retard hydraulically actuated movement of the valve piston in the second longitudinal direction, to facilitate obstructing engagement of the stay piston with the valve piston before the valve piston, when latched, reaches the mode change position. The regarding arrangement may comprise: a plurality of cooperating flow control chambers operatively connected to the valve piston such that longitudinal movement of the valve piston is dependent on corresponding fluid transfer between the cooperating flow control chambers; a fluid passage connecting at least two of the plurality of cooperating flow control chambers; and a flow restrictor in the fluid passage configured to restrict fluid flow between the flow control chambers to a predefined fluid flow rate in response to a pressure differential between the flow control chambers, thereby to limit hydraulically actuated longitudinal movement of the valve piston to a predefined speed.

The downhole tool may be a reamer assembly that comprises a tubular reamer body longitudinally aligned with and connected to the housing to place the activation mechanism of the reamer assembly in fluid pressure communication with the valve port, and one or more cutting elements mounted on the reamer body and configured to ream the borehole wall, the cutting elements being disposable responsive to bore pressure conditions between a deployed condition in which the one or more cutting elements project radially outwards from the reamer body to engage the borehole wall, and a retracted condition in which the one or more cutting elements are retracted to permit rotation of the reamer body free from engagement of the one or more cutting elements with the borehole wall.

The latch mechanism may be configured such that hydraulically actuated movement of the valve piston, when latched, in the second longitudinal direction from a latched rest position to the mode change position responsive to a substantially constant bore-annulus pressure difference is achievable only by provision of the bore-annulus pressure difference at a level below the trigger threshold value and for at least a trigger threshold interval.

The latch mechanism may comprise a barrel cam that is co-axially mounted on the valve piston, being rotatable about the valve piston and being anchored to the valve piston for longitudinal movement therewith, the barrel cam defining an elongated track recess in a radially outer surface thereof, the track recess extending circumferentially about the barrel cam at changing longitudinal positions, the latch mechanism further comprising a latch member mounted on the housing to project radially inwards therefrom, the latch member being received in the track recess in cam-following engagement with the track recess, the track recess being shaped such that longitudinal movement of the barrel cam relative to the latch member causes rotation of the barrel cam.

The track recess may comprise: a latch slot shaped such that, when the latch member is in the latch slot, closure of the valve port by longitudinal movement of the valve piston under urging of the closing bias arrangement is prevented by engagement of the latch member with the latch slot; and an unlatch slot shaped to permit movement of the latch member along it to a position in which the valve port is closed.

Some embodiments disclose a well tool apparatus having a selection mechanism for hydraulically controlling disposal of the apparatus between an active mode and an inactive mode without latching the apparatus in either mode.

In some embodiments, the selection mechanism is configured for exerting a variable direction rotary bias on a cam component, with the direction of the rotary bias being selectable by control of drilling fluid pressure conditions. In one example, a rotary bias mechanism is provided to urge the cam component towards disposing the apparatus in one operational mode at drilling fluid levels below a mode switching threshold, and to urge the cam component to disposing the apparatus in another operational mode at drilling fluid levels above the mode switching threshold. The rotary bias mechanism may comprise a mechanical rotary bias acting in one rotary direction, and a hydraulic rotary bias acting in an opposite rotary direction.

In some embodiments, the selection mechanism may comprise a selector member for physical engagement with a cam component of the well tool apparatus. The selection member may be configured for displacement between a clearing position in which movement of the cam component to dispose the apparatus in a particular one of the operational modes is prevented by physical engagement between the selector member and the cam component, and a clearing position in which movement of the cam component into position to dispose the apparatus into the particular operational mode is permitted.

In some embodiments, the bias mechanism comprises a variable direction bias arrangement to bias movement of the selector member towards one of the positions at drilling fluid levels substantially below a mode switching threshold, and to bias movement of the selector member towards another one of the positions at drilling fluid levels substantially above the mode switching threshold. In some embodiments, the bias mechanism is configured to urge the selector member in opposite radial directions.

Figure 9A:
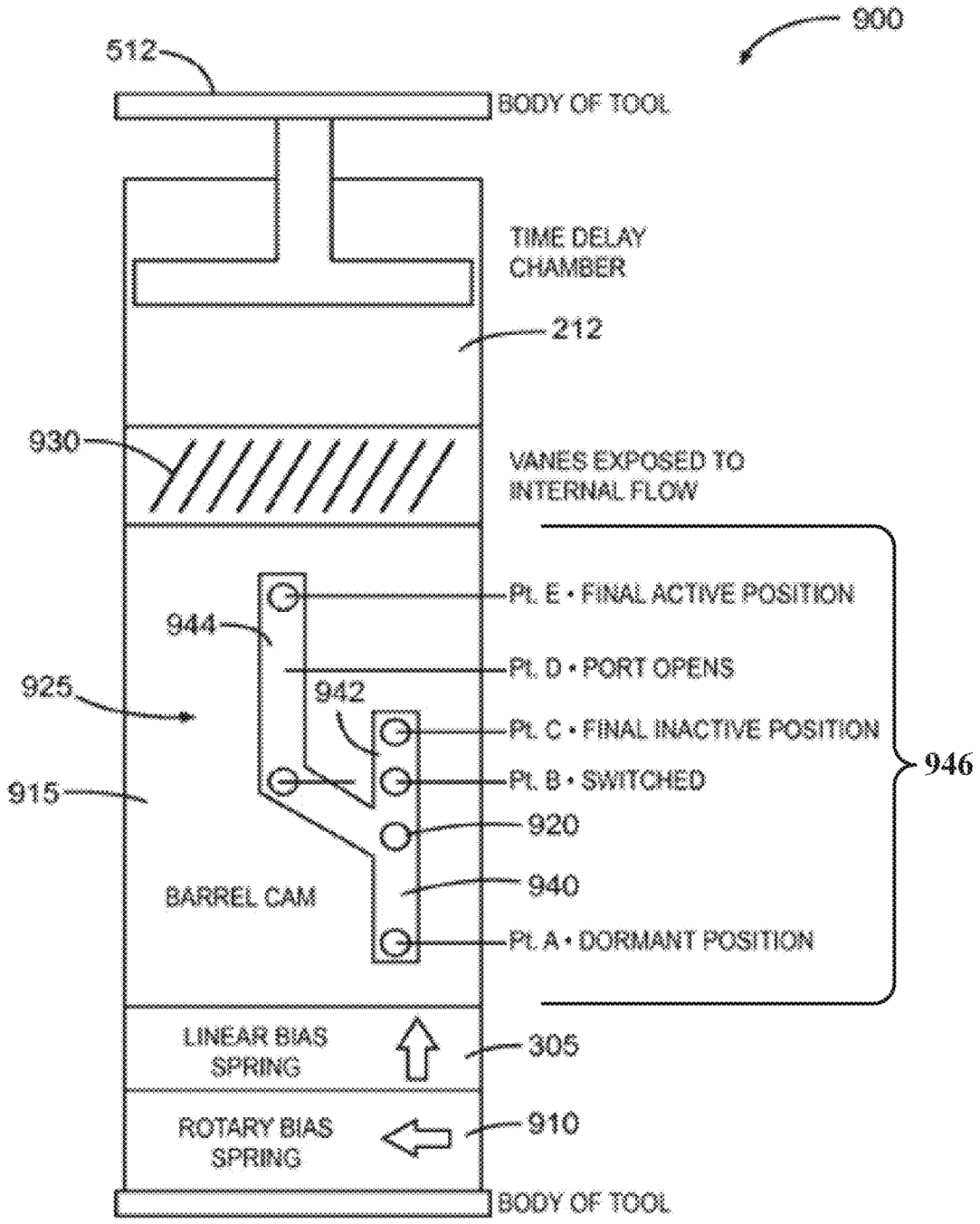
FIG. 9A depicts a schematic diagram of a well tool apparatus comprising a control mechanism for facilitating operator control of downhole tools, according to an example embodiment.
Figure 9B:
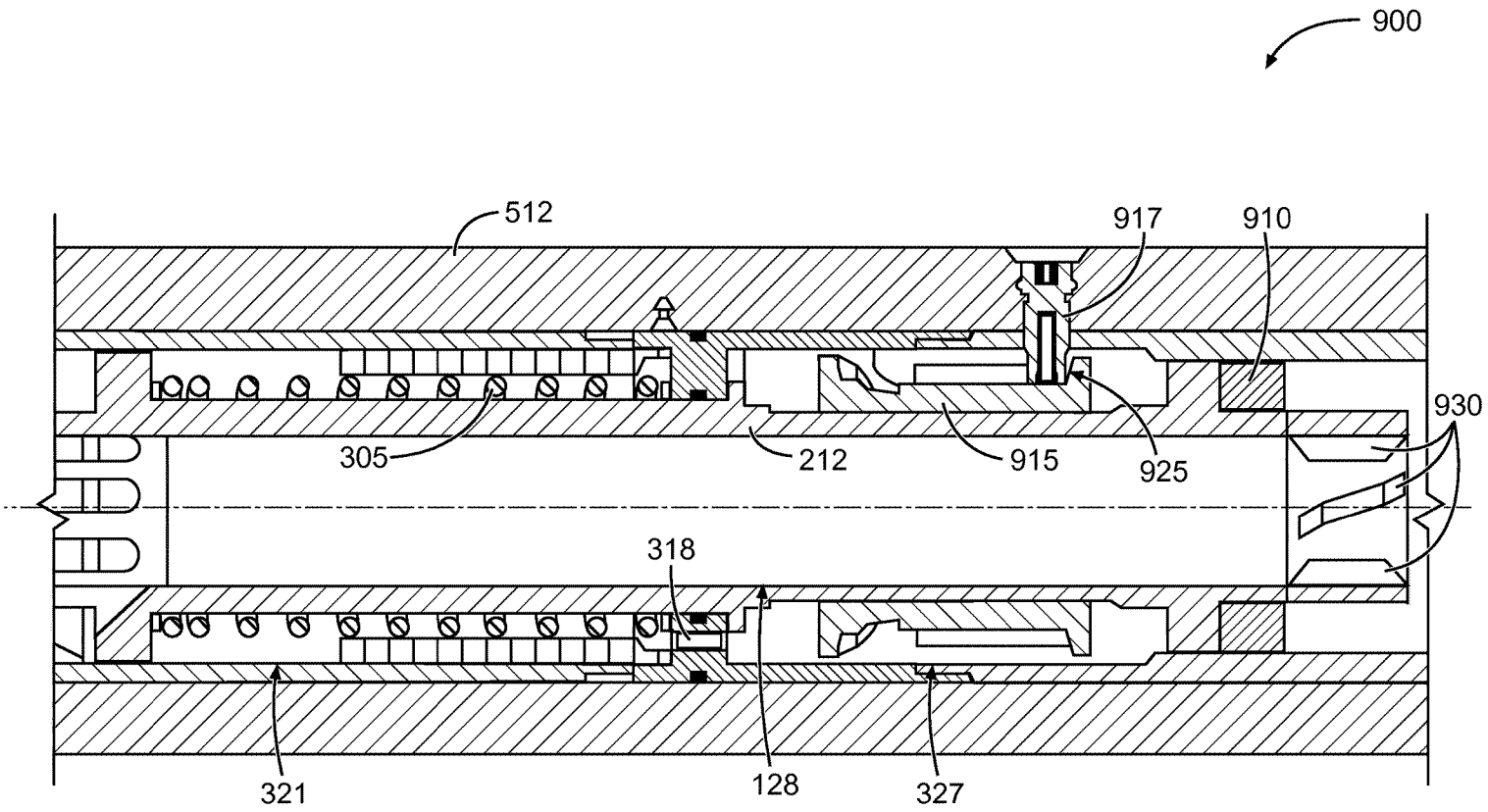
FIG. 9B depicts a schematic axial section of a part of a control mechanism consistent with the example embodiment of FIG. 9A.
Figure 10:
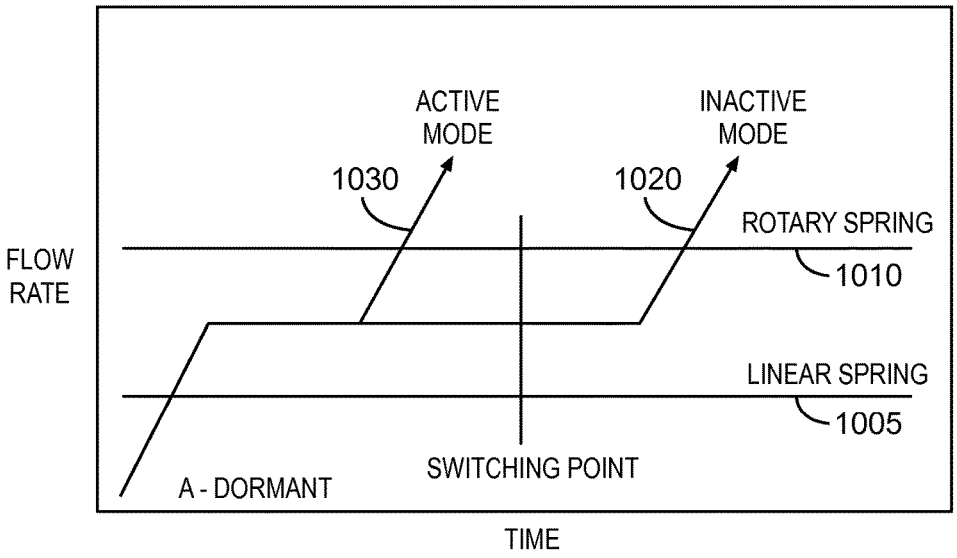
FIG. 10 depicts a schematic diagram illustrating behavior of a control mechanism consistent with the example embodiment of FIG. 9A in response to provision of different flow rate/pressure profiles.
Figure 11A:
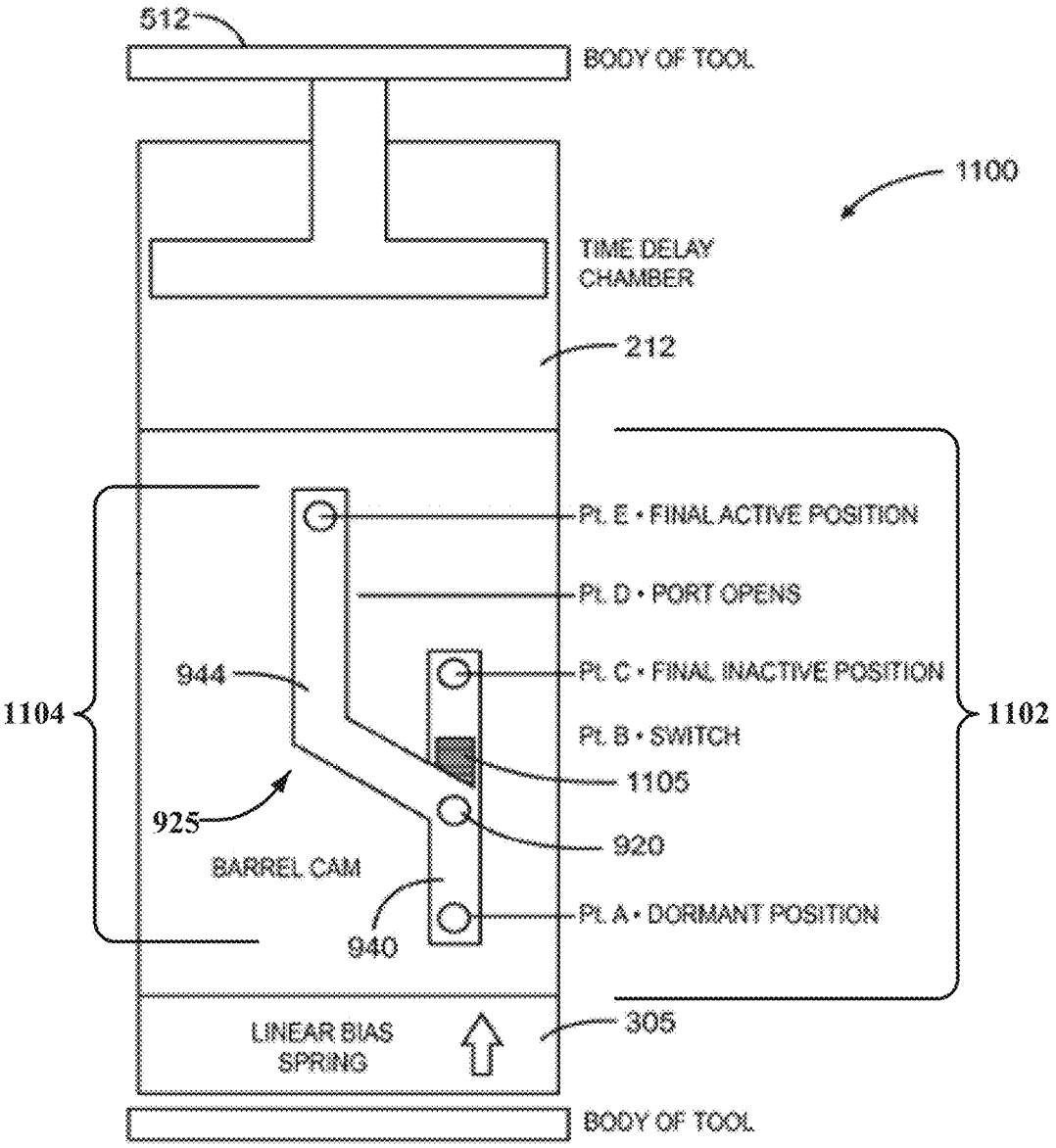
FIG. 11A depicts a schematic diagram of a well tool apparatus comprising a control mechanism for facilitating operator control of downhole tools, according to another example embodiment.
Figure 11B:
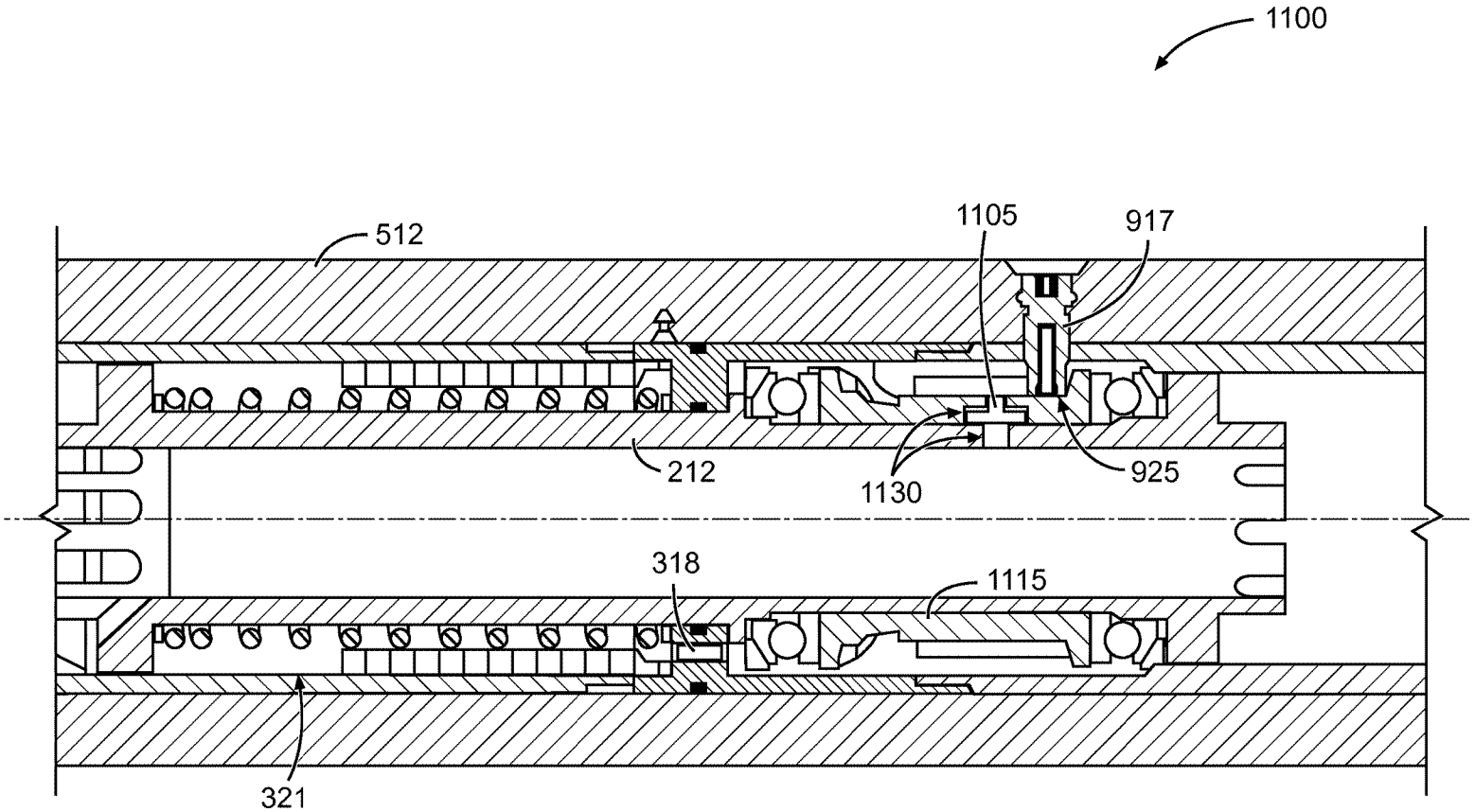
FIG. 11B depicts a schematic axial section of a part of a control mechanism consistent with the example embodiment of FIG. 11A.
Figure 11C:
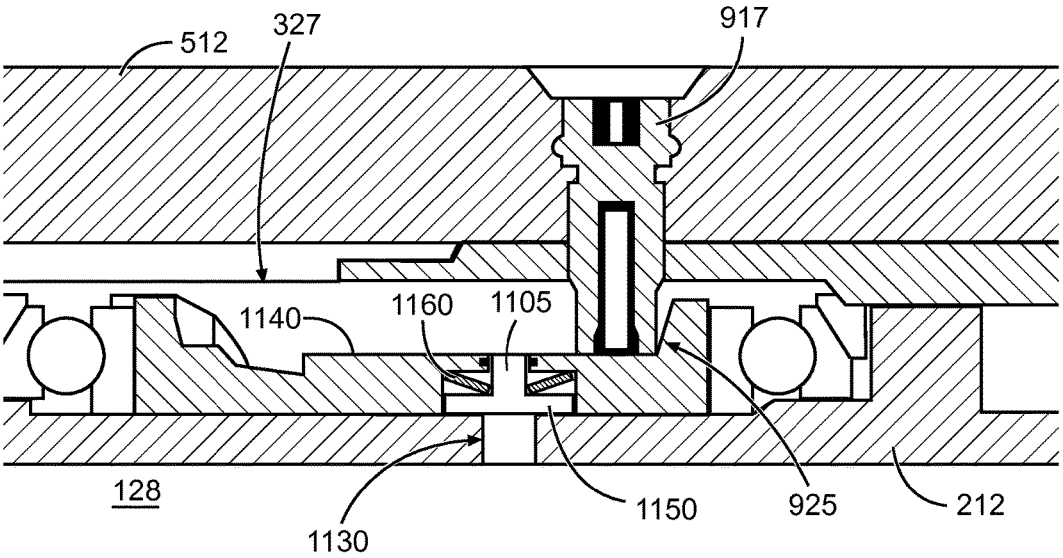
FIG. 11C depicts, on an enlarged scale, an axial section of a part of the control mechanism of FIG. 11B, with a selector pin forming part of the control mechanism being disposed in a clearing position.
Figure 11D:
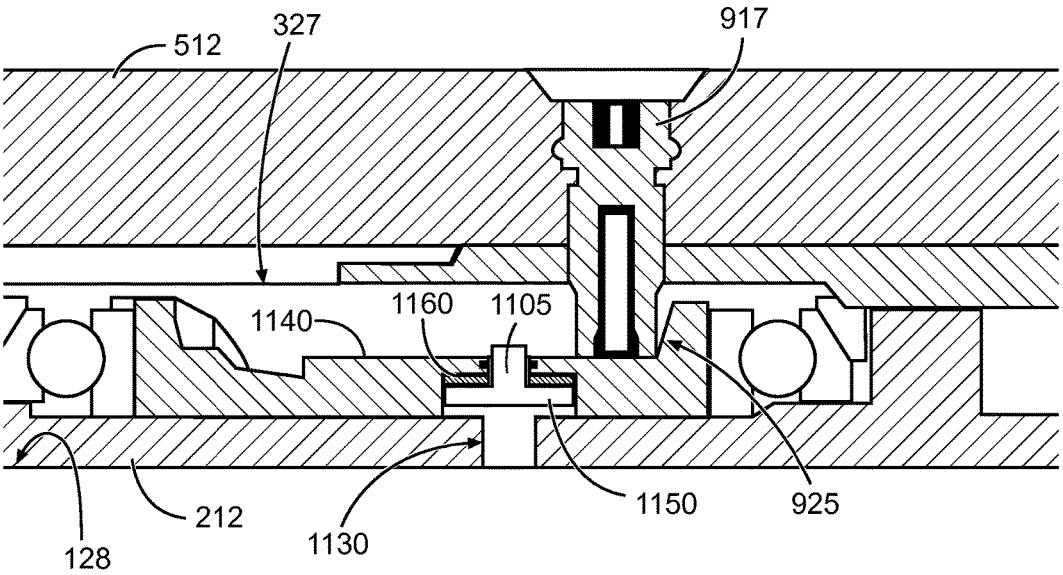
FIG. 11D depicts an axial section corresponding to that of FIG. 11C, with the selector and being in an obstructing position.

FIGS. 9A, 11B, and 10 show an example embodiment of a well tool apparatus comprising a controller 900 for facilitating operator control of downhole tools using drilling fluid as control channel and for hydraulically actuating tool activation. Similar or analogous parts are indicated and referenced by like reference numerals in FIGS. 1-8 and in FIGS. 9-10.

FIG. 9A is a schematic view illustrating some aspects of the controller 900 and its operation, while FIG. 9B is a schematic axial section of a control mechanism forming part of the controller 900 for controlling activation and deactivation drill tools. The controller 900 is similar or analogous to the controller 148 described with reference to FIGS. 1-8, the controller 900 having a tubular housing 215 for end-to-end incorporation in the drill string 108 for a central passage passing through the housing 215 to define part of the longitudinally extending bore 128 of the drill string 108 (see FIG. 9B). The controller body or housing 215 is connected end-to-end to a body of a tool which is to be controlled by the controller 900 in this example embodiment again being a reamer assembly 118 having one or more reamers 144 as previously described with reference to FIGS. 1 and 2.

The controller 900 is also configured similarly to the controller 148 of FIGS. 1-8 with respect to the provision of a valve port 218 (see, e.g., FIG. 4A), which can be opened and closed to control deployment and retraction of the reamer 144, with an axially/longitudinally extending valve piston 212 (FIG. 9B) being axially movable to open and close the valve port 218. In this description, a longitudinal position of the valve piston 212 that corresponds to closure of the valve port 218 by the valve piston 212 is referred to as an open condition of the valve piston 212, while a longitudinal position of the valve piston 212 that corresponds to exposure of the valve port 218, to cause reamer activation, is referred to as a closed condition of the valve piston 212.

Similar to controller 148 described with reference to the example embodiments of FIGS. 1-8, the controller 900 includes a closing bias arrangement that biases the longitudinally valve piston 212 toward a closed condition (in this example embodiment urging the valve piston 212 uphole). The closing bias arrangement is in this example embodiment provided by a closing spring 305 (referenced in FIG. 9A as a linear bias spring) substantially similar to that of the previously described controller 148. The closing spring 305 is elected and configured such that hydraulically actuated movement of the valve piston 212 is resisted for drilling fluid pressure values lower than a predetermined opening threshold, while hydraulically actuated movement of the valve piston 212 in the opening direction is allowed for drilling fluid pressure/flow values above the opening threshold.

The speed of hydraulic actuation of the valve piston 212 in an opening direction towards an open condition (in this example embodiment, downhole) is again governed or retarded by a retarding arrangement (referenced in FIG. 9A as a time delay chamber) comprising a flow restrictor 318 and a fluid passage between a control fluid reservoir 321 and the draw chamber 327. In this example embodiment, the particular construction and features of the above-mentioned elements can be substantially similar to what is described with reference to FIGS. 1-8.

The controller 900 has a cam mechanism acting between the valve piston 212 and the housing 215. In this example embodiment, the cam mechanism comprises a cam member in the example form of a barrel cam 915 mounted on the valve piston 212 for cooperation with a cam follower in the form of a guide pin 917. The guide pin 917 can be similar in construction and operation to the latch pin 315 of the controller 148 (see, for example, FIGS. 4A and 6). The barrel cam 915 is longitudinally anchored to the valve piston 212 for joined axial movement. The barrel cam 915 is in this example embodiment, however, also keyed to the valve piston 212 for rotation therewith relative to the longitudinal axis of the valve piston 212. Note that, whereas substantially no torque is transferred between the barrel cam 315 and the valve piston 212 of the controller 148 of FIGS. 1-8, the valve piston 212 and the barrel cam 915 of the controller 900 can transfer torque or rotational moment between them, being keyed together.

The controller 900 further includes a rotary bias mechanism coupled to the valve piston 212 to urge the valve piston in a first rotary direction. In this example embodiment, the rotary bias mechanism is provided by a rotary spring 910 mounted within the housing 215 to act between the housing and the valve piston 212. The rotary spring 910 is in this example embodiment configured to urge angular movement of the valve piston 212 (and therefore of the barrel cam 915) in an anticlockwise or leftward direction, when viewed in the orientation of FIG. 9A. Note that reference to leftwards in or rightwards rotary movement further in this description refers to the direction of movement of a cam channel 925 visible on the barrel cam 920 in FIG. 9A.

While the rotary bias spring 910 provides a mechanical bias to the valve piston 212, which is applied to the valve piston 212 both in the absence and in the presence of pressurized fluid flow through the controller 900, the bias mechanism in this example also includes a hydraulic bias mechanism which is configured to exert on the valve piston 212 a hydraulic rotary bias that dynamically varies in magnitude with variations in the drilling fluid conditions. In this example, the hydraulic bias mechanism comprises an impeller arrangement for exposure to fluid flow in the controller 900 and to transfer moment or torque to the valve piston 212 (and therefore to the barrel cam 915) in response to dynamic impingement of drilling fluid on the impeller arrangement during pressurized fluid flow through the controller 900. The impeller arrangement here comprises a set of angled vanes 930 co-axially mounted on a tubular wall of the valve piston 212 and projecting radially into the part of the bore 128 defined by the valve piston 212. Drilling fluid under pressure is thus conveyed along the bore 128 and over the vanes 930. The vanes 930 are in this example angled such as to cause a rotary bias on the valve piston 212 in a second rotary direction, opposite to the direction of the bias exerted by the rotary spring 910. The vanes 930 thus provide a rotary bias that acts rightwards, when the controller 900 is viewed in the orientation of FIG. 9A.

Note that the rotary spring 910 is shown in FIG. 9A to be located at an uphole end of the valve piston 212 is, and is shown in FIG. 9B in an alternative configuration of the valve piston 212, in which the vanes 930 are provided at the downhole end of the valve piston 212.

The bias mechanism thus provided by the combined biases of the rotary spring 910 and the vanes 930 is configured such that the bias of the rotary spring 910 is greater than that of the vanes 930 for drilling fluid flow/pressure values below a predetermined level, with the rotary bias of the vanes 930 being greater than that of the rotary spring 910 above the predetermined flow/pressure level. The predetermined fluid pressure conditions at which the direction of resultant bias on the valve piston 212 changes direction is for ease of description referred to as the mode switching threshold.

Turning briefly to FIG. 10, therein is shown a graph of drilling fluid flow rate through the controller 900 over time. In the graph of FIG. 10, the opening threshold of the closing spring 305 is represented by horizontal line 1005, referenced as the linear spring. The mode switching threshold defined by the rotary bias mechanism is represented by line 1010, and is referenced in FIG. 10 as the rotary spring. Differently defined, the opening threshold 1005 represents the flow rate/pressure value at which the bias of the closing spring 305 is overcome by hydraulic action, and the mode switching threshold 1010 represents the flow rate/pressure value at which the bias of the rotary spring 910 is overcome by hydraulic action. As can clearly be seen in FIG. 10, the mode switching threshold 1010 in this example embodiment corresponds to higher flow rates (corresponding to higher fluid pressure values) than the opening threshold 1005.

Returning now to FIG. 9A, therein can be seen for the features of the cam mechanism provided by the cooperating barrel cam 915 and guide pin 917. The barrel cam 915 in this example defines a cam formation or profile in the form of a recessed track or channel 925 for receiving the guide pin 917 and for guiding the guide pin 917 along it in response to axial movement of the valve piston 212. Note, again, that the guide pin 917 in this example embodiment is stationary relative to the housing 215, and that it is the barrel cam 915 that moves relative to the guide pin 917, and whose movement is affected by interaction of the guide pin 917 and the cam channel 925. Description herein of the guide pin 917 following the channel 925 or the cam follower following the cam formation, is to be understood as referring to relative movement between the cooperating cam elements.

The cam channel 925 defines a travel path of the guide pin 917 relative to the barrel cam 915. The cam channel 925 in this example is bifurcated, having a common portion 940, a restricting portion 942, and a release portion 944. The restricting portion 942 and the release portion 944 diverge from the common portion 940 at a junction 920. The common portion 940 and the restricted portion 942 in this example embodiment are in axial alignment, with the release portion 944 extending at a circumferential angle from the common portion 940 at the junction 920. It will be appreciated that for axial positions of the valve piston 212 corresponding to an positions on the far side of the junction 920 from the common portion 940, the guide pin 917 must be received alternatively in either the release portion 944 or the restricting portion 942. Switching between the active and inactive modes of the controller 900 in this example comprises causing entry of the guide pin 917 into either the restricting portion 942 or the release portion 944.

The extreme downhole position of the guide pin 917 in the channel 925 (corresponding to the extreme uphole position of the valve piston 212) is provided by a downhole end of the common portion 940 and defines a dormant position (here indicated as point A) which is assumed by the guide pin 917 in the absence of pressurized flow through the controller 900. It will be appreciated that this is caused by the operation of the closing spring 305, which urges the valve piston 212 uphole, to close the valve port 218.

For pressure/flow values below the opening threshold 1005 (FIG. 10), the valve piston 212 remains substantially stationary, so that the guide pin 917 remains located at point A in the cam channel 925. When pressurized flow of drilling fluid through the controller 900 is at levels substantially between the opening threshold 1005 and the mode switching threshold 1010 (further referred to in this example embodiment as intermediate flow levels), the valve piston 212 is hydraulically actuated to move longitudinally downhole, causing relative travel of the guide pin 917 axially along the common portion 940 towards the junction 920.

There is a particular axial position of the valve piston 212 at which the valve piston 212 switches between the open and closed positions by opening or closing the valve port 218. The location of the guide pin 917 at which the valve port opens (or closes, if the movement is in the closing direction) is indicated in FIG. 9A as point D. Note that the terminus of the restricting portion 942 (referenced herein as point C) is located axially between the dormant position (point A) and the opening position (point D).

Consequently, the extreme downhole position of the valve piston 212 when the guide pin 917 is in the restricted portion 942 corresponds to the closed condition of the valve piston 212, in which the valve port 218 is closed. Location of the guide pin 917 in the restricting portion 942 thus disposes the controller 900 in the inactive mode. This is because application of operational tool pressures (e.g., above the mode switching threshold 1010) while the guide pin 917 is in the restricting portion 942 results only in obstruction of the guide pin 917 against the cam channel 925 at point C. The valve port 218 in such cases thus remains closed irrespective of the magnitude of the fluid pressure/flow applied while the guide pin 917 is in the restricted portion 942.

The opening position of the valve piston 212 (corresponding to point D for the guide pin 917 in the barrel cam 915), however, is located axially between the positions corresponding respectively to the dormant position (point A) and the downhole terminus of the release portion 944 (referenced as point E in FIG. 9A). Because point E is located beyond the port opening position (point D) for pin travel in the opening direction, the extreme downhole position of the valve piston 212 in the release portion 944 of the cam channel 925 corresponds to the open condition of the valve port 218. The controller 900 can thus be seen in this example embodiment to be in the active mode when the guide pin 917 is located in the release portion 944 of the cam channel 925. This is because application of operational fluid pressures while the guide pin 917 is in the release portion 944 will result in movement of the valve piston 212 to open the valve port 218, axial movement of the valve piston 212 being stopped by the cam mechanism only when the guide pin 917 arrives at and obstructs against the cam channel 925 at point E (at which point the valve port is open).

In this example embodiment, operator selection of the particular mode in which the controller 900 is disposed functions through the operation of the rotary bias mechanism. Recall that, at intermediate flow/pressure levels, the net rotary bias exerted on the barrel cam 915 (via the valve piston 212) acts rightwards relative to the cam channel 925 illustrated in FIG. 9A. At such intermediate levels, the barrel cam 915 is thus traditionally biased to cause entry of the guide pin 917 into the restricting portion 942 at the junction 920 in response to relative longitudinal movement of the valve piston 212. Because the common portion 940 and the restricting portion 942 are longitudinally aligned in this example, the guide pin 917 will enter the restricting portion 942 when moving past the junction 920 in the direction away from point A, because entry of the guide pin 917 into the release portion 944 would require rotary movement of the barrel cam 915 (and therefore of the valve piston 212) in a direction opposite to the bias of the rotary spring 910 (which is dominant in biasing the barrel cam 915 at intermediate flow levels).

If, however, drilling fluid flow/pressure levels are above the mode switching threshold 1010 when the guide pin 917 coincides with the junction 920 in the cam channel 925, the resultant bias on the barrel cam 915 acts leftwards in the orientation of the cam channel 925 shown in FIG. 9A, towards entry into the release portion 944. The guide pin 917 in such cases automatically enters the release portion 944 (in this example by rotary movement of the barrel cam 915 and the valve piston 212 such that the guide pin 917 follows the release portion 944), therefore being disposed in the active mode. Note that the rotary bias mechanism in this example biases the cam mechanism to the inactive mode for intermediate flow levels, and biases the cam mechanism to the active mode for flow levels above the mode switching threshold 1010.

Referring now also to FIG. 10, the operations to be performed by an operator to dispose the controller 900 in either the active mode or the inactive mode are illustrated by two different pressure profiles. Starting with pumps off so that the guide pin 917 is at the dormant position (point A), and ramping up of fluid flow to intermediate levels (e.g., above the opening threshold 1005 of the closing spring 305) causes longitudinal displacement of the valve piston 212, to move the guide pin 917 from point A towards the junction 920.

If intermediate flow levels are maintained until the guide pin 917 arrives at the junction 920, the guide pin 917 enters the restricted portion 942, and the controller 900 is switched to the inactive mode. Thereafter, drilling fluid pressure levels can be ramped up without causing the valve port 218 to open and the reamer 144 to be deployed. This pressure profile is represented by line 1020 in FIG. 10.

Recall that, through operation of the flow restrictor 315, the speed of hydraulically actuated displacement of the valve piston 212 downhole is controlled, so that the interval for moving of the guide pin 917 from point A to the mode switching position represented by the junction 920 is substantially fixed (here, referred to as the trigger interval). Thus, it can be seen that the controller 900 is configured to switch to the inactive mode only in response to provision of a predefined pressure profile, in this example comprising application of intermediate flow levels for at least the trigger interval.

If, for example, the operator ramps up fluid flow levels above the mode switching threshold before expiry of the trigger interval, the cam mechanism is urged to the active mode before and when the barrel cam 915 reaches the switching point (corresponding to axial registering between the guide pin 917 at the junction 920). As a result, the barrel cam 915 is rotationally urged by the hydraulic bias of the vanes 930 to cause entry of the guide pin 917 into the release portion 944. This causes switching of the controller 900 to the active mode, as indicated by line 1030 in FIG. 10. Note that the described bias mechanism therefore provides a selection mechanism 946 for enabling operator-selection of the mode of operation of the controller 900.

FIGS. 11A-11D illustrate another example embodiment of an apparatus for controlling downhole tool operation, in the example form of a controller 1100. Like reference numerals indicate like parts in the preceding description and in FIG. 11. The controller 1100 is analogous in operation and construction to the controller 900 described with reference to FIG. 9 in that it is configured for providing mode selecting and switching functionality that operates similarly to that described with reference to the pressure profile graph of FIG. 10. Portions of the above description regarding operator-controlled selection of the controller 1100 to function in the active mode or in the inactive mode thus apply mutatis mutandis to the embodiment of FIGS. 11A-11D.

A distinction, however, between the controller 900 FIG. 9 and the controller 1100 of FIG. 11 comprises differences in the mode selection mechanism 1102. The controller 1100 has a barrel cam 915 that defines a cam channel 925 identical to that of the controller 900. The controller 1100 does not, however, comprise a rotational bias mechanism to control whether the guide pin 917 enters the restricting portion 942 or the release portion 944. In the example embodiment of FIG. 11, the controller 1100 therefore does not have the rotary spring 910 or the vanes 930 as described with reference to the controller 900. The barrel cam 915 of the controller 1100 is furthermore rotatable relative to the valve piston 212 about the longitudinal axis of the valve piston 212. The mounting of the barrel cam 915 is thus analogous to that described with reference to FIG. 4.

The controller 1100 comprises a selection mechanism 1102 having a selector member 1104 that is configured for hydraulic activation to switch between a position in which the guide pin 917 enters the constriction portion in response to axial movement of the valve piston 212 such that the guide pin 917 reaches the junction 920, and a position in which the guide pin 917 enters the constriction portion in response to axial movement of the valve piston 212.

Turning now to the schematic view of FIG. 11A (which corresponds to FIG. 9A), it can be seen that the selector member 1104 in this example embodiment comprises a switch pin 1105 that is located in the cam channel 925 for interfering with movement of the guide pin 917 along the cam channel 925. The switch pin 1105 is in this instance mounted in the constricted portion immediately beyond the junction 920.

When the switch pin 1105 projects radially into the channel 925 at this position, it interferes with movement of the guide pin 917 into the restricted portion 942, thus guiding angular displacement of the axially actuated barrel cam 915 to cause the guide pin 917 to move into the release portion 944. The switch pin 1105 in this example has a circumferentially inclined guide face corresponding to the angle of the release portion 944 at the junction 920. The guide face is oriented such that the guide pin 917 impinges on it during relative axial travel along the cam channel 925, and to promote diversion of the travel path of the guide pin 917 into the release portion 944.

As can be seen in FIG. 11B, the switch pin 1105 is mounted in a radial fluid passage 1130 that extends radially through the tubular wall of the valve piston 212, through the barrel cam 915, and into the draw chamber 327 in which the barrel cam 915 is located. As in the example embodiment described with reference to FIG. 4, the draw chamber 327 is maintained substantially at annulus pressure. The fluid passage 1130 of the switch pin 1105 thus has a radial pressure differential across it corresponding substantially to the bore annulus pressure differential.

Turning now to the 11C, it is shown that the switch pin 1105 is sealingly engaged with the walls of the fluid passage 1130 where it extends through the floor 1140 of the cam channel 925 in the barrel cam 915. The switch pin 1105 further has a base flange 1150 that seats on the radially outer surface of the valve piston 212 and that is held captive between the barrel cam 915 and the valve piston 212. It will be appreciated that the switch pin 1105 is thus mounted piston/cylinder-fashion in the radial passage 1130 for hydraulic actuation radially outwardly. Radial escape of the switch pin 1105 is prevented by capture of the base flange 1150 between the barrel cam 915 and the valve piston 212.

The selector mechanism comprising the switch pin 1105 further includes a radial bias mechanism to exert a radial bias on the switch pin for urging it radially between a clearance position (FIG. 11C) in which it allows movement of the guide pin 917 in the channel 925 past it and an interference position (FIG. 11D) in which the switch pin 1105 is positioned for obstructing movement of the guide pin 917 along the channel 925. In this example embodiment, the radial bias mechanism is provided by a radial spring 1160 in the example form of a Belleville spring or washer that acts against the base flange 1150 and is configured to bias the switch pin 1105 radially inwardly, towards its clearing position.

Note that the radial bias mechanism for the switch pin 1105 again comprises a mechanical component (provided by the radial spring 1160 and acting radially inwardly, towards the clearing position) and a hydraulic component (provided by the pressure differential across the radial passage 1130 and acting on the differential surfaces respectively of the projecting portion of the switch pin 1105 and the base flange 1150, respectively.

The hydraulic features of the selector mechanism and the strength of the radial spring 1160 are in this instance selected such that, for fluid flow/pressure substantially below the mode switching threshold, the radial spring bias is greater than the radial hydraulic bias, so that the switch pin 1105 is urged radially inwardly, to its clearing position (the 11C). For fluid flow/pressure conditions substantially at or above the mode switching threshold, the outwardly acting hydraulic bias is greater than the radial spring bias, thereby urging the switch pin 1105 radially outwards, into its interference position (FIG. 11.)

Returning again to FIG. 11A, will now be understood that when the controller 900 is an intermediate pressure/flow levels (i.e., below the mode switching threshold), the switch pin 1105 is radially retracted, being substantially flush with the floor 1140 of the cam channel 925, and thus clearing the restricting portion 942 at the junction 920. Because the restricting portion 942 is axially aligned with the common portion 940 in which the dormant position (point A) is located, axially actuated movement of the valve piston 212 (resulting from fluid pressure/flow levels above the closing bias of the closing spring 305) in response to fluid pressure/flow levels lower than the mode switching threshold 1010 results in continued travel of the latch pin in a rectilinear travel path relative to the barrel cam 915. The guide pin 917 thus travels in a straight axial path into the restricting portion 942, past the retracted switch pin 1105, when the intermediate fluid conditions are provided for at least the trigger interval. Selection of the inactive mode by provision of a trigger pressure profile is thus identical to that illustrated by line 1020 in FIG. 10.

Similar to the controller 900 of FIG. 9, application of fluid pressure/flow at levels above the mode switching threshold 1010 before expiry of the trigger threshold results in disposal of the cam mechanism in the active mode, as illustrated by the pressure profile of line 1030 in FIG. 10. This is effected by automatic radial displacement of the switch pin 1105 radially outwardly into the obstructing position (FIG. 11D) in response to provision of above-threshold pressure conditions. When hydraulically actuated axial movement of the valve piston 212 results in arrival of the junction 920 in the cam channel 925 at the guide pin 917, the guide pin 917 obstructs against the guide face of the switch pin 1105. The barrel cam 915 is as a result of engagement with the switch pin 1105 and the angled leg of the release portion 944 turned rotationally about the longitudinal axis. The switch pin 1105 is thus prevented from entering the restricted portion 942 and, by relative movement of the barrel cam 915, enters the release portion 944 of the cam channel 925. In this manner, the controller 900 is disposed to the active mode.

It is a benefit of the above-described examples and hydraulic-controlled mode selection is enabled without provision of a latch mechanism, or a staying arrangement to look the controller in a particular mode. Simpler construction enabled by these features may have cost and reliability benefits.

From the above-described example embodiments, it will be seen that one aspect of the disclosure includes an apparatus comprising valve arrangement defining a valve port that is connectable to a hydraulic activation mechanism of a well tool incorporated in the drill;

a valve piston that is mounted in the housing and configured for cooperation with the valve port by longitudinal displacement of the valve piston within the housing between an open condition, in which a fluid connection between the bore and the well tool via the valve port is permitted, and a closed condition in which the valve port is closed;

a cam mechanism configured to act between the valve piston and the housing to selectively control an available range of longitudinal movement of the valve piston, the cam mechanism being disposable between an inactive mode in which the valve piston is prevented from longitudinal movement under hydraulic actuation into the open condition upon application of bore pressures at or above tool activation levels, to prevent hydraulic tool activation, and an active mode in which the valve piston is movable under hydraulic actuation into the open condition upon application of bore pressures at or above tool activation levels; and a selection mechanism configured for permitting operator-controlled selective mode switching of the cam mechanism in response to the provision of a predefined pressure profile in the drilling fluid.

In some embodiments, the cam mechanism comprises a pair of cooperating cam components that are anchored against longitudinal movement relative to the housing and to the valve piston respectively, the pair of cam components comprising a cam follower, and a cam member having a cam formation that is configured for engagement by the cam follower and that defines a travel path of the cam follower relative to the cam member in response to longitudinal movement of the valve piston within the housing. The travel path may comprise a restricting portion configured to prevent, by obstructive engagement with the cam follower, longitudinal movement of the valve piston into a position blocked by the restricting portion, the blocked position corresponding to at least one of the open condition and the closed condition, and a release portion configured to permit longitudinal movement of the valve piston into the blocked position.

The cam mechanism may be configured such that the restricting portion prevents longitudinal movement of the valve piston to the open condition. In some embodiments, the cam formation is configured such that the travel path includes a common portion, the restricting portion and the release portion diverging as alternative paths from the a mode switch point at the common portion.

In some embodiments, the selection mechanism may be configured to effect mode switching by exerting a rotary bias to cause one of the alternative paths to be followed by relative motion of the cam follower. In some embodiments, the selection mechanism may be configured to effect mode switching by obstructing entry of the cam follower on to one of the alternative paths, thereby causing the cam follower to follow the other one of the alternative paths.

In some rotary-bias embodiments, the cam mechanism may be connected to the valve piston to allow torque transfer from the valve piston to the cam mechanism. The selection mechanism may comprise a rotary bias mechanism configured to exert a rotary bias on the valve piston for causing mode switching of the cam mechanism by angular movement of the valve piston. In some embodiments, the rotary bias mechanism may be configured to act in a first rotary direction at drilling fluid pressures lower than a predefined mode switching threshold, and to act in a second, opposite rotary direction at fluid pressures substantially above the mode switching threshold.

The apparatus may further comprise a longitudinal bias mechanism configured to urge the valve piston longitudinally towards the closed condition, the longitudinal bias mechanism being configured to permit hydraulically actuated longitudinal movement of the valve piston towards the open condition in response to provision of drilling fluid pressures substantially above a predefined opening threshold, and to resist hydraulically actuated longitudinal movement of the valve piston towards the open condition at drilling fluid pressures substantially below the opening threshold, wherein the mode switching threshold is greater than the opening threshold. In some embodiments, the first rotary direction is oriented such that rotary bias of the valve piston tends to dispose the cam mechanism in the inactive mode.

The rotary bias mechanism may comprise a rotary spring mechanism acting to bias the valve piston in the first rotary direction, towards the inactive mode. In some embodiments, the rotary bias mechanism may further comprise a hydraulic bias mechanism configured to urge the valve piston in the second direction responsive to fluid flow through the bore, the rotary bias being dynamically variable in magnitude in response to variation in drilling fluid conditions. In some embodiments, the hydraulic bias mechanism comprises a set of vanes connected to the valve piston and disposed at an angle to longitudinal fluid flow through the valve piston.

The described embodiments further disclose a drilling installation which includes the well tool apparatus, as well as a method comprising use of the well tool apparatus.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus comprising:

a generally tubular housing configured for incorporation in a drill string that is to extend longitudinally along a borehole, the housing defining a longitudinally extending passage configured to define part of a drill string bore for conveying drilling fluid;

a valve arrangement defining a valve port that is connectable to a hydraulic activation mechanism of a well tool incorporated in the drill string;

a valve piston that is mounted in the housing and configured for cooperation with the valve port by longitudinal displacement of the valve piston within the housing between an open condition, in which a fluid connection between the bore and the well tool via the valve port is permitted, and a closed condition in which the valve port is closed;

a cam mechanism configured to act between the valve piston and the housing to selectively control an available range of longitudinal movement of the valve piston, the cam mechanism being disposable between an inactive mode in which the valve piston is prevented from longitudinal movement under hydraulic actuation into the open condition upon application of bore pressures within the drill string at or above tool activation levels, to prevent hydraulic tool activation, and an active mode in which the valve piston is movable under hydraulic actuation into the open condition upon application of bore pressures within the drill string at or above tool activation levels; and a selection mechanism configured for permitting operator-controlled selective mode switching of the cam mechanism in response to the provision of a predefined pressure profile in a drilling fluid.

2. The apparatus of claim 1, wherein the cam mechanism comprises a pair of cooperating cam components that are anchored against longitudinal movement relative to the housing and to the valve piston respectively, the pair of cam components comprising a cam follower, and a cam member having a cam formation that is configured for engagement by the cam follower and that defines a travel path of the cam follower relative to the cam member in response to longitudinal movement of the valve piston within the housing, the travel path comprising a restricting portion configured to prevent, by obstructive engagement with the cam follower, longitudinal movement of the valve piston into a blocked position that is blocked by the restricting portion, the blocked position corresponding to at least one of the open condition and the closed condition, and a release portion configured to permit longitudinal movement of the valve piston into the blocked position.

3. The apparatus of claim 2, wherein the cam mechanism is configured such that the restricting portion prevents longitudinal movement of the valve piston to the open condition.

4. The apparatus of claim 2, wherein the cam formation is configured such that the travel path includes a common portion, the restricting portion and the release portion diverging as alternative paths from the a mode switch point at the common portion.

5. The apparatus of claim 4, wherein the selection mechanism is configured to effect mode switching by exerting a rotary bias to cause one of the common portion, the restricting portion and the release portion paths to be followed by relative motion of the cam follower.

6. The apparatus of claim 4, wherein the selection mechanism is configured to effect mode switching by obstructing entry of the cam follower on to one of the common portion, the restricting portion and the release portion paths, thereby causing the cam follower to follow another one of the common portion, the restricting portion and the release portion paths.

7. The apparatus of claim 1, wherein the cam mechanism is connected to the valve piston to allow torque transfer from the valve piston to the cam mechanism.

8. The apparatus of claim 7, wherein the selection mechanism comprises a rotary bias mechanism configured to exert a rotary bias on the valve piston for causing mode switching of the cam mechanism by angular movement of the valve piston.

9. The apparatus of claim 8, wherein the rotary bias mechanism is configured to act in a first rotary direction at a drilling fluid pressures lower than a predefined mode switching threshold, and to act in a second, opposite rotary direction at fluid pressures substantially above the mode switching threshold.

10. The apparatus of claim 9, further comprising a longitudinal bias mechanism configured to urge the valve piston longitudinally towards the closed condition, the longitudinal bias mechanism being configured to permit hydraulically actuated longitudinal movement of the valve piston towards the open condition in response to provision of drilling fluid pressures substantially above a predefined opening threshold, and to resist hydraulically actuated longitudinal movement of the valve piston towards the open condition at drilling fluid pressures substantially below the opening threshold, wherein the mode switching threshold is greater than the opening threshold.

11. The apparatus of claim 9, wherein the first rotary direction is oriented such that rotary bias of the valve piston tends to dispose the cam mechanism in the inactive mode.

12. The apparatus of claim 11, wherein the rotary bias mechanism comprises a rotary spring mechanism acting to bias the valve piston in the first rotary direction, towards the inactive mode.

13. The apparatus of claim 12, wherein the rotary bias mechanism further comprises a hydraulic bias mechanism configured to urge the valve piston in the second direction responsive to fluid flow through the bore, the rotary bias being dynamically variable in magnitude in response to variation in drilling fluid conditions.

14. The apparatus of claim 13, wherein the hydraulic bias mechanism comprises a set of vanes connected to the valve piston and disposed at an angle to longitudinal fluid flow through the valve piston.

15. The apparatus of claim 2, wherein the selection mechanism comprises a selector member configured for pressure-activated displacement between an interfering position in which it obstructs relative movement of the cam follower on to one of the restricting portion and the release portion of the travel path, and a clearing position in which it permits relative movement of the cam follower on to on to on of the restricting portion and the release portion of the travel path, the selection mechanism further being configured to switch between the interfering position and the clearing position at drilling fluid pressures corresponding substantially to a predefined mode switching threshold.

16. The apparatus of claim 15, wherein the selector member is switchable between the interfering position and the clearing position by radial movement of the selector member, the selection mechanism further comprising a radial bias mechanism configured to resist hydraulically actuated radial movement of the selector member in response to drilling fluid pressures substantially below the mode switching threshold, and to allow radial movement of the selector member at drilling fluid pressures substantially above the mode switching threshold.

17. The apparatus of claim 15, wherein the cam formation comprises a guide channel along which the cam follower is guidable in response to relative longitudinal movement of the valve piston, the selector member being configured for, in the interfering position, projecting into the guide channel to prevent movement of the cam follower along the channel best the selector member, and, in the clearing position, clearing the guide channel.

18. The apparatus of claim 1, wherein the well tool comprises a reamer assembly, the reamer assembly comprising:

a tubular reamer body longitudinally aligned with and connected to the housing to place the activation mechanism of the reamer assembly in fluid pressure communication with the valve port; and one or more cutting elements mounted on the reamer body and configured to ream a borehole wall, the cutting elements being disposable responsive to bore pressure conditions within the drill string between, a deployed condition in which the one or more cutting elements project radially outwards from the reamer body to engage the borehole wall, and a retracted condition in which the one or more cutting elements are retracted to permit rotation of the reamer body free from engagement of the one or more cutting elements with the borehole wall.

19. A method comprising:

controlling operation of a downhole tool coupled in a drill string extending longitudinally along a borehole by controlling drill string pressure conditions to cause response by a control mechanism operatively coupled to the downhole tool and defining a valve port that is connectable to a hydraulic activation mechanism of the downhole tool, the control mechanism further comprising, a valve piston that is mounted in the housing and configured for cooperation with the valve port by longitudinal displacement of the valve piston within the housing between an open condition, in which a fluid connection between the bore and the well tool via the valve port is permitted, and a closed condition in which the valve port is closed;

a cam mechanism configured to act between the valve piston and the housing to selectively control an available range of longitudinal movement of the valve piston, the cam mechanism being disposable between an inactive mode in which the valve piston is prevented from longitudinal movement under hydraulic actuation into the open condition upon application of bore pressures within the drill string at or above tool activation levels, to prevent hydraulic tool activation, and an active mode in which the valve piston is movable under hydraulic actuation into the open condition upon application of bore pressures within the drill string at or above tool activation levels; and a selection mechanism configured for permitting operator-controlled selective mode switching of the cam mechanism in response to the provision of a predefined pressure profile in the drilling fluid.

* * * * *